US006547878B2

(12) United States Patent
Rutledge et al.

(10) Patent No.: US 6,547,878 B2
(45) Date of Patent: Apr. 15, 2003

(54) FLUID DISPENSING SYSTEM AND METHOD FOR CONTAINER CLOSURE MEMBERS

(75) Inventors: Clinton W. Rutledge, Highlands Ranch, CO (US); Tracy J. Fowler, Lakewood, CO (US)

(73) Assignee: Alcoa Packaging Machinery, Inc., Englewood, CO (US)

( * ) Notice: Subject to any disclaimer, the term of this patent is extended or adjusted under 35 U.S.C. 154(b) by 0 days.

(21) Appl. No.: 10/016,802

(22) Filed: Oct. 29, 2001

(65) Prior Publication Data

US 2002/0048633 A1 Apr. 25, 2002

Related U.S. Application Data

(63) Continuation of application No. 09/447,448, filed on Jan. 22, 1999, now Pat. No. 6,391,387.

(60) Provisional application No. 60/146,555, filed on Jul. 30, 1999, and provisional application No. 60/110,036, filed on Nov. 25, 1998.

(51) Int. Cl.[7] ..... B05C 13/00

(52) U.S. Cl. ..... 118/52; 118/319; 118/321; 118/323; 118/500; 427/207.1; 427/208.4; 427/256; 427/284

(58) Field of Search ..... 427/207.1, 208.4, 427/256, 284; 118/319, 321, 323, 52, 500

(56) References Cited

U.S. PATENT DOCUMENTS 2,419,951 A * 5/1947 Kastel ..... 91/43
3,403,658 A * 10/1968 Damm et al. ..... 118/6
6,391,387 B1 * 5/2002 Rutledge et al. ..... 427/256

* cited by examiner

*Primary Examiner*—Katherine A. Bareford
(74) *Attorney, Agent, or Firm*—Klaas, Law, O'Meara & Malkin, P.C.; Michael A. Goodwin, Esq.

(57) ABSTRACT

A sealant dispensing system is disclosed which is capable of applying sealant material to irregularly shaped, i.e., non-circular, closure members. To accomplish this, the closure member is loaded onto a rotary chuck in a conventional manner. The sealant applying gun, however, is moveable relative to the end. In this manner, through a combination of rotation of the closure member and movement of the gun, the gun is able to follow the outline of a closure member of any shape. In order to allow non-circular closure members to be loaded onto a chuck, the chuck must first be stopped. After the closure member is loaded, chuck rotation is then initiated. In order to allow this selective chuck rotation, the chuck may be attached to a servo motor. An electromagnet may be located in proximity to each chuck of the sealant dispensing system. In this manner, the electromagnet may be activated during loading of the end of the closure member onto the chuck and then deactivated when it is time to unload the closure member from the chuck. In an indexing type sealant dispensing system, the shuttle mechanism may be driven by a cam device, rather than a conventional crank mechanism. The cam device allows the motion characteristics of the shuttle mechanism to be precisely controlled such that machine cycle time can be reduced.

6 Claims, 26 Drawing Sheets

FLUID DISPENSING SYSTEM AND METHOD FOR CONTAINER CLOSURE MEMBERS

This application is a Continuation of application Ser. No. 09/447,448 filed Nov. 22, 1999, now U.S. Pat. No. 6,391, 387 B1, which claims priority from U.S. Provisional Application No. 60/110,036, filed Nov. 25, 1998, and U.S. Provisional Application No. 60/146,555, filed Jul. 30, 1999, all of which are hereby incorporated by reference for all that is disclosed therein.

FIELD OF THE INVENTION

The present invention relates generally to a fluid dispensing system and method and, more particularly, to a sealant delivery system and apparatus for application of a sealant compound material to non-circular container closures.

BACKGROUND OF THE INVENTION

It is conventional to apply sealant to the underside of container closure members in order to facilitate subsequent sealing attachment of the closure members to containers. Such sealant is normally applied in an annular pattern on the underside of each closure member in a manner such that, when the closure is attached to the container, the applied sealant will be located between the container rim and the closure member and, thus, seal the closure to the container.

One example of such a container closure is a can lid or "end", as it is often referred to in the can-making industry. During the manufacture of a can end, a sealant, such as a latex sealant, is conventionally applied to the underside of a curl region of the end. After the can is filled, the end is seamed onto the upper flange of the can and the previously applied sealant material facilitates sealing between the curl area of the end and the flange of the can to which it is attached in order to prevent leakage.

Another example of such a container closure is a bottle cap or "crown", as it is often referred to in the bottling industry. In a similar manner to the can end described above, bottle crowns are conventionally provided with a sealant material such that, when the crown is subsequently attached to a filled bottle, the sealant material will be located between the crown and the bottle, thus facilitating sealing attachment of the crown to the bottle.

To apply sealant to a container closure in a manner as described above, a sealant dispensing apparatus is generally used. Such an apparatus is often referred to in the industry, and may be referred to herein, as a "sealant dispensing gun" or simply a "gun". Such sealant dispensing guns typically include a supply line which supplies liquid sealant to the gun, and a valve, such as a needle valve, for allowing the liquid sealant to be selectively dispensed from the gun. A container closure is generally supported by a chuck member which locates the closure adjacent the gun in the desired position. The closure is then rotated at a high speed by the chuck while the sealant dispensing gun valve is opened, thus resulting in an arcuate, even application of liquid sealant onto the underside of the closure. After application, the liquid sealant cures to form a solidified ring of resilient sealing material.

The extent of the rotational coverage of sealant on the closure may be adjusted by controlling the valve "dwell time" which is a measure of the time that the valve remains in its open position. Rotational coverage of a closure member with sealant is dictated by the valve dwell time relative to the rotational speed of the chuck and attached closure member. The dispense rate of sealant through the valve may also be controlled by adjusting the extent to which the needle valve opens.

Sealant dispensing guns are conventionally found in either stationary, indexing machines or in rotary machines. In an indexing machine, a sealant dispensing gun is stationarily mounted while the container closures to be coated are indexed through the machine. An example of such an indexing sealant dispensing machine for applying sealant to bottle crowns is described in U.S. Pat. No. 3,412,971 of McDivitt for ELECTRICALLY-CONTROLLED VALVE APPARATUS AND CONTROL CIRCUIT SUITABLE FOR USE THEREIN, which is hereby incorporated by reference for all that is disclosed therein.

In a rotary machine, a plurality of sealant dispensing guns are generally revolvingly mounted with respect to an axis. A rotary closure member feed mechanism is provided having a series of pockets which locate a closure member beneath each of the rotating guns. Each of the closure members is then sequentially lifted, engaged by a chuck member and rotated while the adjacent sealant dispensing gun applies sealant thereto. Examples of rotary sealant dispensing machines are set forth in U.S. Pat. Nos. 4,262,629 of McConnellogue et al. for APPARATUS FOR APPLICATION OF SEALANT TO CAN LIDS; 4,840,138 of Stirbis for FLUID DISPENSING SYSTEM; 5,215,587 of McConnellogue et al. for SEALANT APPLICATOR FOR CAN LIDS; 5,749,969 of Kobak et al. for FLUID DISPENSING SYSTEM; 6,010,740 of Rutledge et al. for FLUID DISPENSING SYSTEM and 6,113,333 of Rutledge et al. for APPARATUS AND METHOD FOR APPLYING SEALANT TO A CAN LID, which are all hereby incorporated by reference for all that is disclosed therein.

Some sealant dispensing guns include valves which are operated by cams and mechanical linkage arrangements. In these types of machines, the valve dwell time and the valve open limit are generally dictated by the specific physical cam and cam follower arrangement used. Accordingly, adjusting the valve dwell time or valve open limit in such machines generally requires a time consuming and expensive process of replacing various mechanical elements. Examples of such mechanical actuation arrangements are illustrated in U.S. Pat. Nos. 4,262,629 and 4,840,138, referenced above.

More common in recent years, however, are sealant dispensing guns in which the sealant dispensing gun valve is actuated by an electrical solenoid device or devices. In such guns, the valve dwell time is dictated not by mechanical linkages and cams, but instead by the amount of time that the valve opening solenoid is energized. Accordingly, the use of such electrical solenoid devices allows the valve dwell time of a sealant dispensing gun to be easily varied. Examples of sealant dispensing guns utilizing electrical solenoid valve actuation devices are illustrated in U.S. Pat. Nos. 3,412,971; 5,215,587 and 5,749,969, as previously referenced.

Since the cam actuation mechanism is eliminated in sealant dispensing guns having solenoid valve actuation devices, this type of gun generally also includes an adjustable mechanism for controlling the valve open limit. This adjustable mechanism may control the valve open limit by providing a movable stop for the valve stem or by moving the valve opening solenoid itself, or both.

In addition to solenoid valve actuation, some sealant dispensing guns also employ solenoid or motor actuated devices to adjust the valve open limit. Such guns allow remote control of the open limit and, thus, the rate at which sealant is dispensed from the gun when the valve is in its open position. Examples of sealant dispensing guns incorporating solenoid or motor actuated valve open limit devices are illustrated in U.S. Pat. Nos. 5,215,587 and 5,749,969, as previously referenced.

Although many closure members are circular, e.g., most soft drink can closure members, many closure members are irregularly shaped, i.e., are non-circular. Although the sealant dispensing systems described above generally work well, none of them are capable of applying sealant to irregular, i.e., non-circular, closure members. Accordingly, a need exists to provide a sealant dispensing system capable of applying sealant to irregular closure members.

Many existing sealant dispensing machines include magnets to assist in locating closure members on the machine when ferrous, e.g, steel, closure members, are to be coated with sealant. The magnets are generally located in conjunction with the chuck members such that the magnets tend to assist in locating the ferrous closure members on the chucks and maintaining them in place while sealant is applied. It has been found, however, that such magnets sometimes hinder the ability to remove the closure members from the chucks when coating has been completed.

In a stationary, indexing type machine, a shuttle mechanism typically serves to sequentially move uncoated closure members from a supply of closure members to the chuck of the sealant application mechanism. One limitation on the speed of an indexing machine is the length of time required to move a closure member into place on the chuck. Typically an indexing machine shuttle mechanism is driven by a crank device which, in turn, is driven by the main machine drive unit. The use of such a crank device inherently limits the speed of the shuttle mechanism and, thus, ultimately limits the speed at which the indexing type machine can operate.

Thus, it would be generally desirable to provide an apparatus and method which overcomes these problems associated with sealant dispensing devices as described above.

SUMMARY OF THE INVENTION

A sealant dispensing system is disclosed which is capable of applying sealant material to irregularly shaped, i.e., non-circular, closure members. To accomplish this, the closure member is loaded onto a rotary chuck in a conventional manner. The sealant applying gun, however, is moveable relative to the closure member. In this manner, through a combination of rotation of the closure member and movement of the gun, the gun is able to follow the outline of a closure member of any shape. To accomplish this, the gun may be mounted for pivotal movement. Alternatively, the gun may be mounted to allow translational, i.e., substantially linear movement. In either case, the movement may be achieved through the use of a servo motor. Alternatively, the movement may be achieved through the use of a linear actuator, such as a linear electromagnetic actuator.

In order to allow non-circular closure members to be loaded onto a chuck, the chuck must first be stopped. After the closure member is loaded, chuck rotation is then initiated. In order to allow this selective chuck rotation, the chuck may be attached to a servo motor.

An electromagnet may be located in proximity to each chuck of the sealant dispensing system. In this manner, the electromagnet may be activated during loading of the end of the closure member onto the chuck and then deactivated when it is time to unload the closure member from the chuck. Power to the electromagnet may be maintained during sealant application in order to ensure that the closure member remains in place on the chuck.

In an indexing type sealant dispensing system, the shuttle mechanism may be driven by a cam device, rather than a conventional crank mechanism. The cam device allows the motion characteristics of the shuttle mechanism to be precisely controlled such that machine cycle time can be reduced.

DETAILED DESCRIPTION OF THE INVENTION

Figure 1:
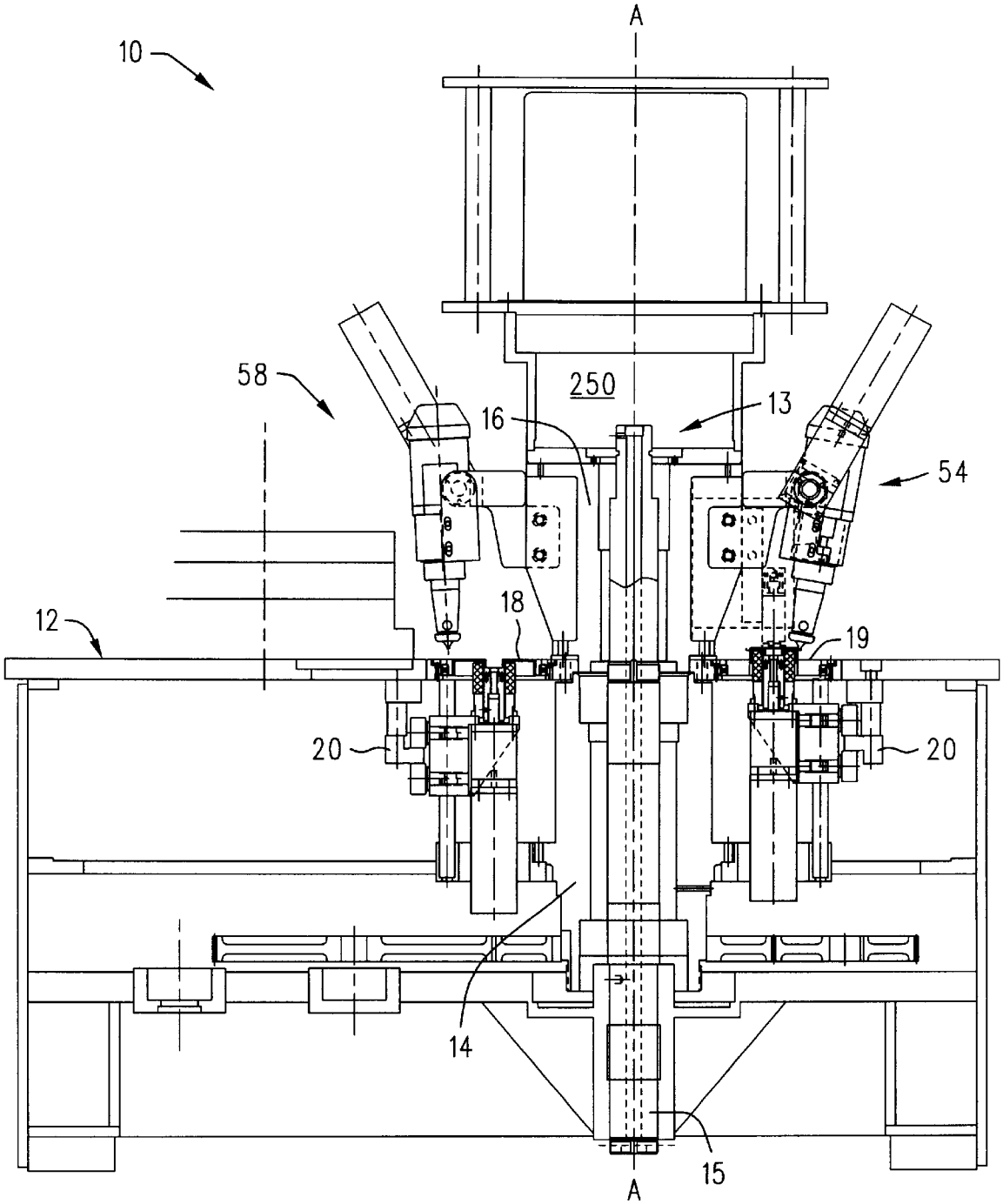
FIG. 1 is a partial cross-sectional elevation view of a fluid dispensing system.

FIGS. 1–27, in general, illustrate a method of applying a fluid to a member 100. The method includes providing a fluid dispensing mechanism 120 having an opening 122 therein; dispensing the fluid from the opening 122 in the fluid dispensing mechanism 120 onto the member 100 and pivoting the dispensing mechanism 120 about a pivot axis C—C.

FIGS. 1–27 also illustrate, in general, a fluid dispensing apparatus 10 for applying fluid to a member 10. The fluid dispensing apparatus 10 includes: a support structure 12; a fluid dispensing mechanism 120 having: a first opening in the fluid dispensing mechanism 120, the first opening being attached to a supply of fluid; a second opening 122 in the fluid dispensing mechanism 120; a fluid flow path extending through the fluid dispensing mechanism 120 and connecting the first opening and the second opening 122; and wherein the fluid dispensing mechanism 120 is pivotally attached to the support structure 12 about a pivot axis C—C.

FIGS. 1–27 also illustrate, in general, a method of applying a fluid to an article 100. The method includes providing a first member 82 which is rotatable about a rotation axis B—B; providing an electromagnet 86 proximate the first member 82; providing a fluid dispensing mechanism 120 located proximate the first member 82; loading the article 100 onto the first member 82; rotating the first member 82 about the rotation axis B—B; applying fluid to the article 100 with the fluid dispensing mechanism 120; providing a first level of electrical current to the electromagnet 86 while the fluid is being applied to the article 100.

FIGS. 1–27 also illustrate, in general, an apparatus 10 for applying fluid to a member 100. The apparatus includes a support structure 12; a support member 82 rotatably mounted to the support structure 12 about a rotation axis B—B; a fluid dispensing mechanism 120 attached to the support structure 12, the fluid dispensing mechanism 120 including: a first opening in the fluid dispensing mechanism, the first opening being attached to a supply of fluid; a second opening 122 in the fluid dispensing mechanism 120, the second opening 120 located proximate the support member 82; a fluid flow path extending through the fluid dispensing mechanism 120 and connecting the first opening and the second opening 122; an electromagnet 86 located in proximity to the support member 82.

FIGS. 1–27 also illustrate, in general, a method of applying a fluid to a member 500. The method may include providing a fluid dispensing mechanism 610 having an opening therein; providing a linear actuator 660 operatively associated with the fluid dispensing mechanism 610; dispensing the fluid from the opening in the fluid dispensing mechanism 610 onto the member 500; and displacing the fluid dispensing mechanism 610 relative to the member 500 with the linear actuator 660.

FIGS. 1–27 also illustrate, in general, a fluid dispensing apparatus 416 for applying fluid to a member 500. The fluid dispensing apparatus 416 may include a fluid dispensing mechanism 610 having a first opening in the fluid dispensing mechanism 610, the first opening being attached to a supply of fluid; a second opening in the fluid dispensing mechanism 610 and a fluid flow path extending through the fluid dispensing mechanism and connecting the first opening and the second opening. The fluid dispensing apparatus 416 may further include a linear actuator 660 operatively associated with the fluid dispensing mechanism 610.

FIGS. 1–27 also illustrate, in general, an apparatus 410 for applying fluid to members 500. The apparatus 410 may be of the type having a fluid dispensing mechanism 610 and a shuttle mechanism 496 for moving the members 500 from a first location 500 to a second location 482 adjacent the dispensing mechanism 610. The apparatus 410 may include a support structure 412. The shuttle mechanism 496 may be movably attached to the support structure 412. A cam 512 may be operatively associated with the shuttle mechanism 496.

FIGS. 1–27 also illustrate, in general, a method for applying fluid to members 500. The method may include providing: a structure having a fluid dispensing mechanism 610 having a chuck member 482 operatively associated therewith; a first location adjacent a supply of the members 500; a second location adjacent the fluid dispensing mechanism 610 and a shuttle mechanism 496 adapted to move the members 500 from the first location to the second location. The method may further include locating the shuttle mechanism 496 at the first location; loading at least one of the members 500 onto the shuttle mechanism 496 while the shuttle mechanism is located at the first location; moving the shuttle mechanism 496, along with the member loaded thereon, in a first direction 505 toward the second location; causing the shuttle mechanism 496 to dwell at the second location and transferring the member from the shuttle mechanism 496 to the chuck 482 while the shuttle mechanism 496 is caused to dwell at the second location.

Having provided the general description above, the method and apparatus will now be described in further detail.

Figure 4:
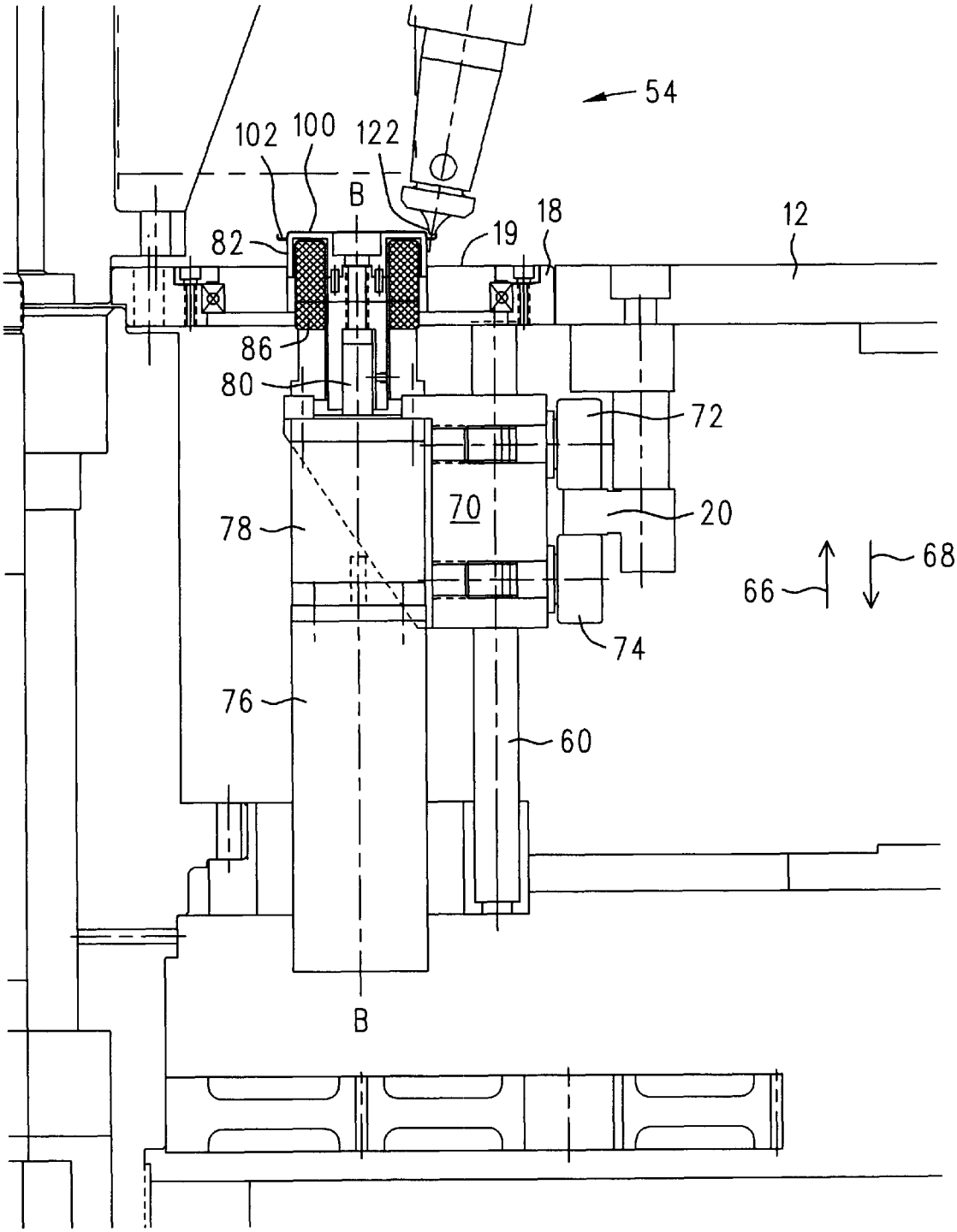
FIG. 4 is a partial cross-sectional elevation detail view of a portion of the lower turret assembly of FIG. 3.

FIG. 1 illustrates a rotary sealant dispensing system 10. Sealant dispensing system 10 may include a support structure 12. A main turret assembly 13 may comprise a central shaft 15, a lower turret assembly 14 and an upper turret assembly 16. The main turret assembly 13 may be rotatably mounted within the support structure about the axis A—A, as illustrated in FIG. 1 and may be rotated via a conventional main drive motor 290 and gears 292, illustrated schematically in FIG. 8. Referring again to FIG. 1, a rotary table 18 may be fixedly attached to both the lower and upper turrets 14, 16 and may, thus, be rotatable therewith about the axis A—A. Rotary table 18 may have an upper surface 19 as shown in FIG. 4. A cam 20 may be fixedly attached to the support structure 12 as illustrated. The dispensing system 10 may also include a plurality of sealant dispensing stations 50, such as the individual stations 52, 54, 56 and 60, e.g., FIGS. 2 and 3, which are mounted so as to also be revolvable about the axis A—A.

Each of the sealant dispensing stations 50 may be substantially identical. Accordingly, only the station 54 will be described in detail herein, it being understood that the other stations may be formed in a substantially identical manner. FIG. 4 illustrates the lower portion of the station 54 in greater detail. A pair of carriage guide rods 60, 62, FIGS. 3 and 4, may be fixedly attached to the lower turret assembly 14 at a lower end thereof and to the rotary table 18 at an upper end thereof. A carriage 70 may be slidingly attached to the guide rods 60, 62 for reciprocal movement in the directions 66, 68 of FIG. 4. A pair of cam followers 72, 74 may be rotatably attached to the carriage 70 such that they engage the stationary cam 20.

A servo motor 76 and a reduction gear box 78 may be mounted to the carriage 70 as shown. The servo motor 76 and gear box 78 may be arranged in a conventional manner such that the output shaft of the servo motor 76 engages with the input drive of the gear box 78. An output shaft 80 of the gear box 78 may be attached to a chuck 82 as shown. As can be appreciated, activation of the servo motor 76 will, through the reduction gear box 78, cause rotation of the chuck 82 about the rotational axis B—B. Servo motor 76 may be a conventional servo motor and may, for example, be of the type commercially available from Allen Bradley Company of 1201 S. Second Street, Milwaukee, Wis. 53204 and sold as Model No. N-2304-1-F00AA. Gear box 78 may be a conventional reduction gear box and may, for example, be of the type commercially available from CGI, Inc. of 3400 Arrowhead Drive, Carson City, Nev. 89706 and sold as Model No. NEMA23-9:1 Planetary Gearhead.

Figure 5:
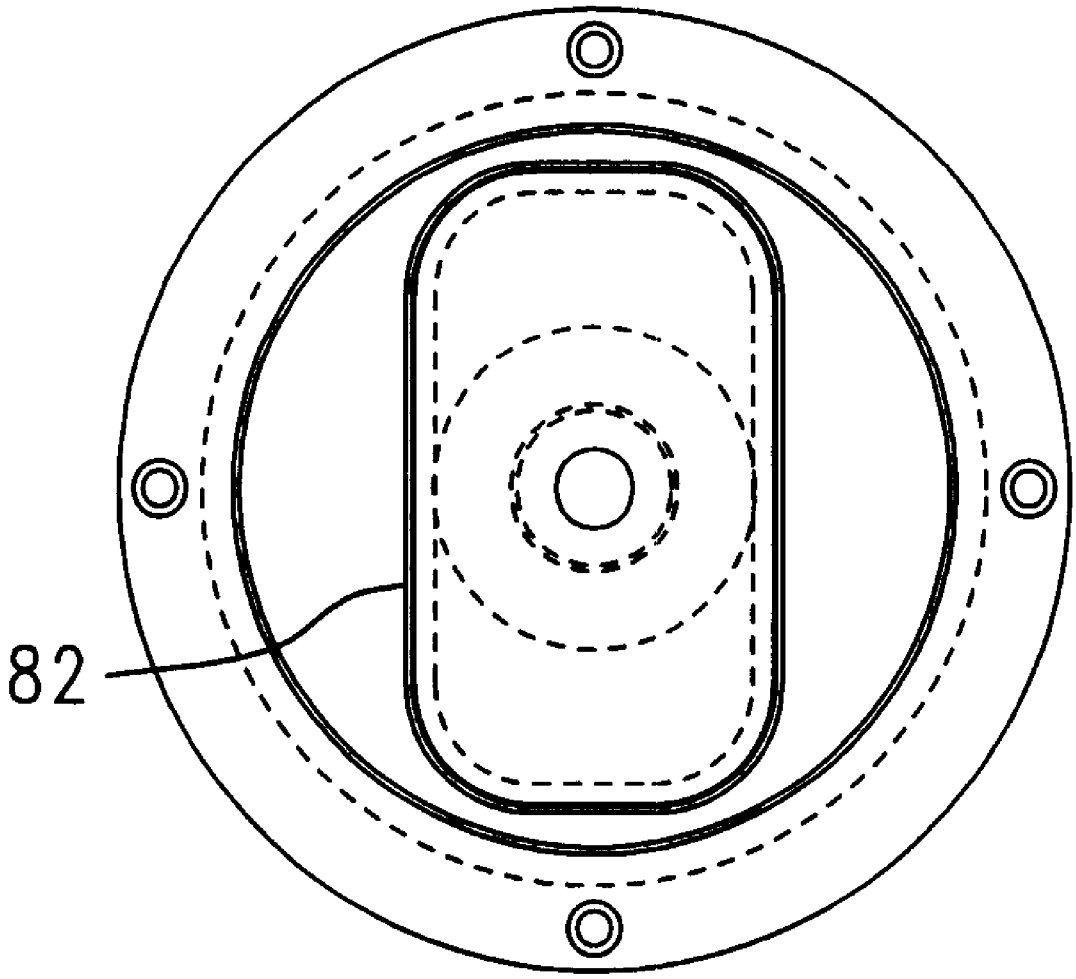
FIG. 5 is a top plan view of a chuck member used in conjunction with the fluid dispensing system of FIG. 1.

Chuck 82 may be configured to receive a closure member 100, such as a can end. Closure member 100 may include a flange portion 102 as shown. FIG. 5 illustrates the chuck 82 in plan view. As can be appreciated, the chuck 82 may by shaped to correspond to the shape of the closure member being handled by the sealant dispensing system 10. The chuck 82 may, for example, have an oblong-shape as illustrated in FIG. 5 when a closure member of corresponding oblong shape is being handled by the system 10. It is to be understood, however, that the specific shape of the chuck 82 is illustrated in FIG. 5 for exemplary purposes only. The sealant dispensing system 10 could be used in conjunction with closure members of any shape and the chuck 82 could readily be adapted to fit a closure member of any shape.

Referring to FIG. 4, an electromagnet 86 may be mounted to the carriage 70 in a non-rotatable fashion as shown. Electromagnet 86 may be formed in substantially the shape of an annulus.

Figure 6:
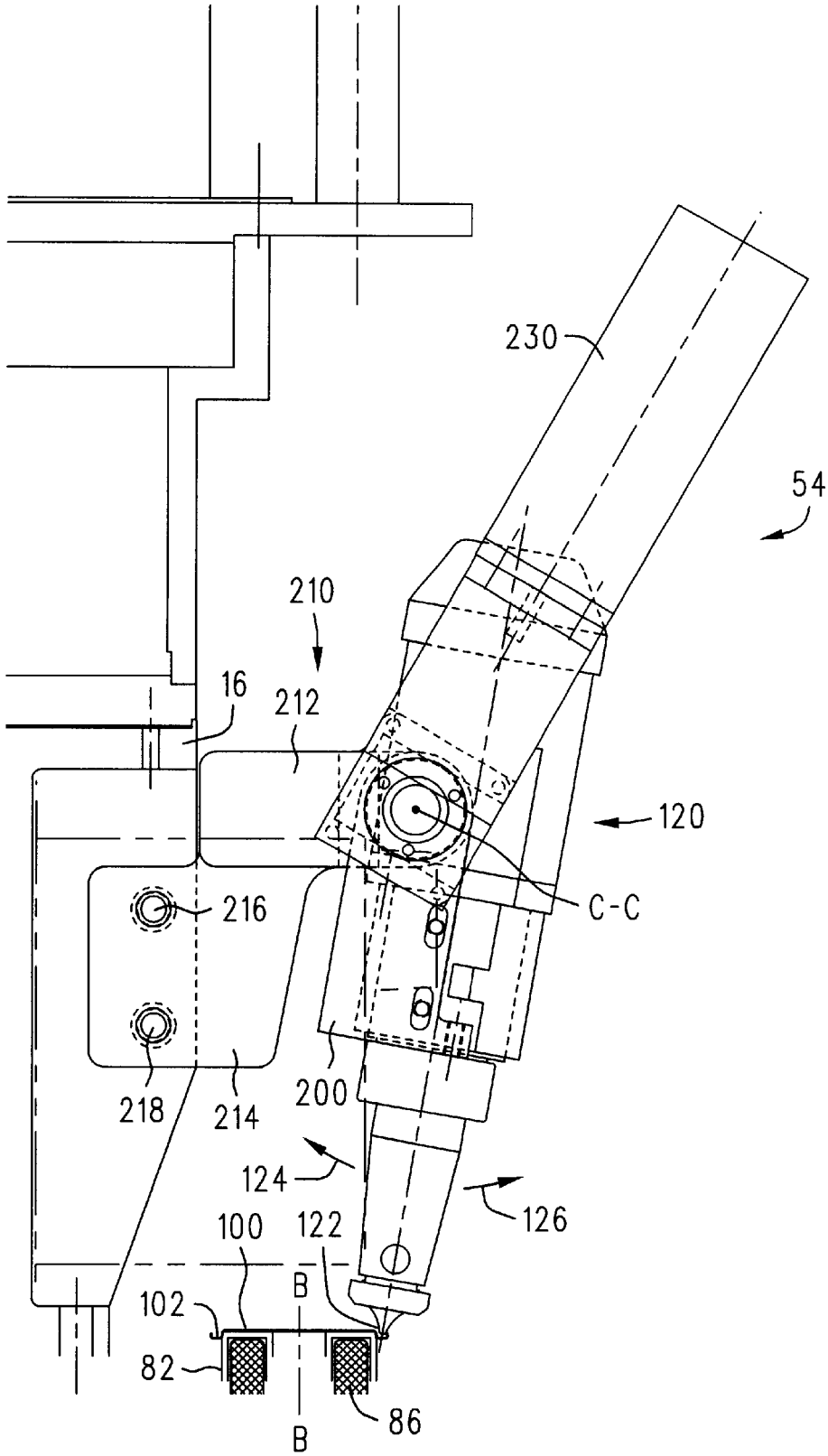
FIG. 6 is a partial cross-sectional front elevation detail view of a portion of the upper turret assembly of FIG. 2.

FIG. 6 illustrates the upper portion of the station 54 in greater detail. Referring to FIG. 6, a sealant dispensing gun 120 may be provided as shown. Sealant dispensing gun 120 may be any conventional type of sealant dispensing gun and may, for example, be an electronic sealant dispensing gun of the type disclosed in U.S. Pat. No. 5,749,969 or U.S. Pat. No. 6,010,740, previously referenced.

Sealant dispensing gun 120 may include a sealant dispensing opening 122. The gun 120 may be attached to a supply of sealant material via a conduit, not shown, in a conventional manner. As can be appreciated with reference to FIG. 6, when a closure member 100 is mounted on the chuck 82, as shown, the dispensing gun opening 122 will be located adjacent the flange portion 102 of the closure member 100 and will, thus, be in position to apply sealant material to the flange 102. As can further be appreciated, when the closure member 100 is a circular closure member, merely rotating the member 100 about the axis B—B will cause all portions of the flange 102 to pass directly beneath the sealant gun opening 122. The sealant dispensing gun 120 is, thus, able to apply sealant material to the entire flange 102.

Figure 7:
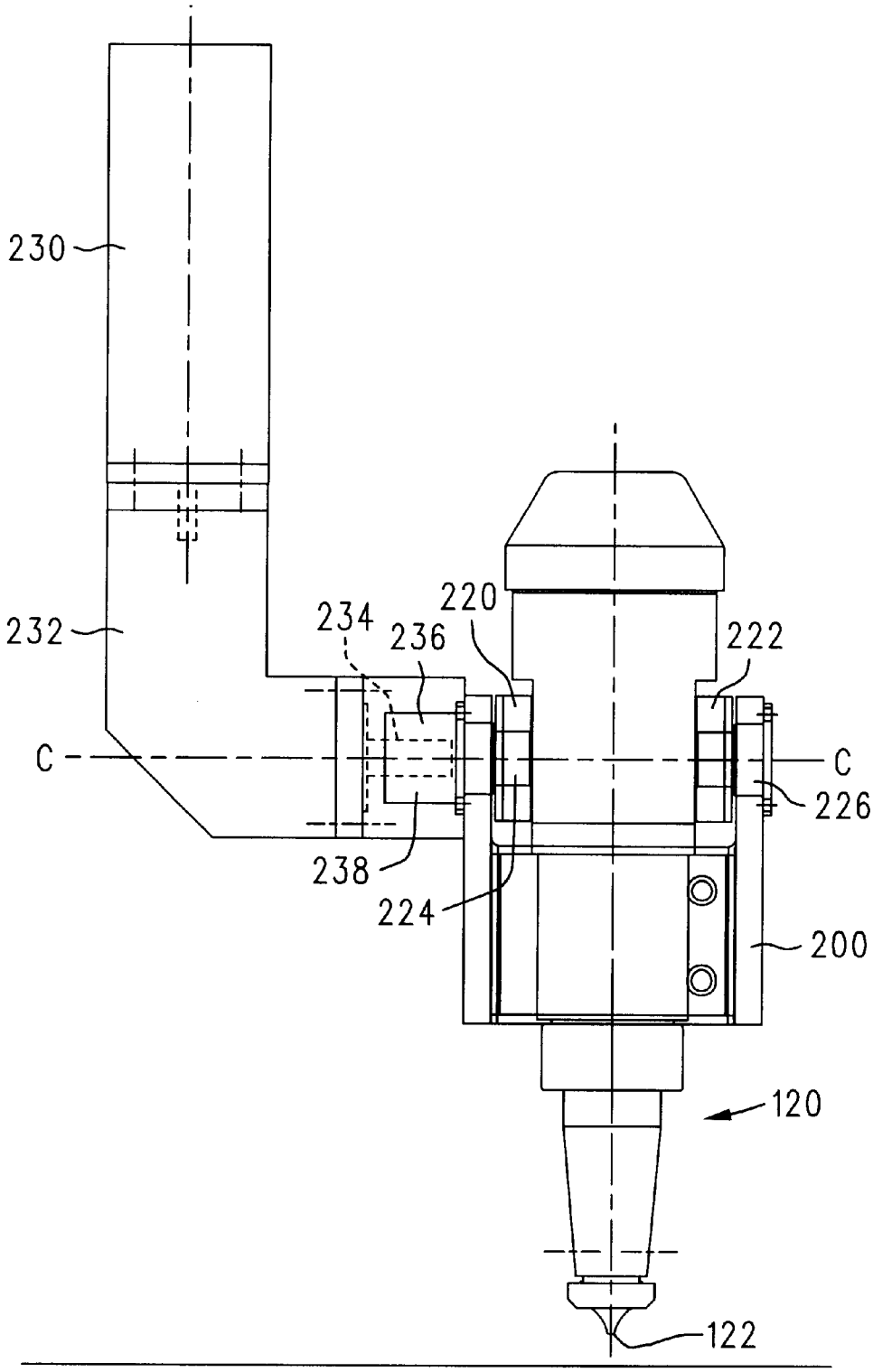
FIG. 7 is a side elevation detail view of a portion of the upper turret assembly of FIG. 2.

In the case however, where an irregular closure member, such as the oblong member 100, is to be coated, mere rotation of the member about the axis B—B will not cause all portions of the flange 102 to pass beneath the opening 122. Accordingly, to facilitate applying sealant to irregular closure members, the gun 120 may be mounted for pivoting movement about the axis C—C as illustrated in FIGS. 6 and 7. Accordingly, the gun opening 122 is able to move in the arcuate directions generally indicated by the arrows 124, 126, FIG. 6. As can be appreciated, the combination of the rotation of the closure member 100 about the axis B—B and the pivoting of the gun 120 about the axis C—C allows the gun opening 122 to follow the flange portion of a closure member of any shape and, thus, apply sealant material thereto.

As can be appreciated, the interaction of the stationary cam 20 and the revolving cam followers 72, 74, FIG. 4, will cause the carriage 70 and, thus, the attached chuck 82, to move in an upward direction 66 and a downward direction 68 between a raised position as illustrated, for example, with respect to the station 54 in FIG. 1 and a lowered position as illustrated, for example, with respect to the station 58 in FIG. 1. As can be seen from FIG. 1, the chuck of the station 54 is raised above the upper surface 19 of the rotary table 18 such that the gun opening 122, FIG. 4, is located proximate the closure member flange portion 102 to facilitate the dispensing of sealant from the gun onto the flange portion 102. Referring again to FIG. 1, the chuck of the station 58, however, is flush with the upper surface 19 and retracted from the gun opening to facilitate the loading of a closure member onto the chuck of the station 58 in a manner as will be described in further detail herein.

Figure 2:
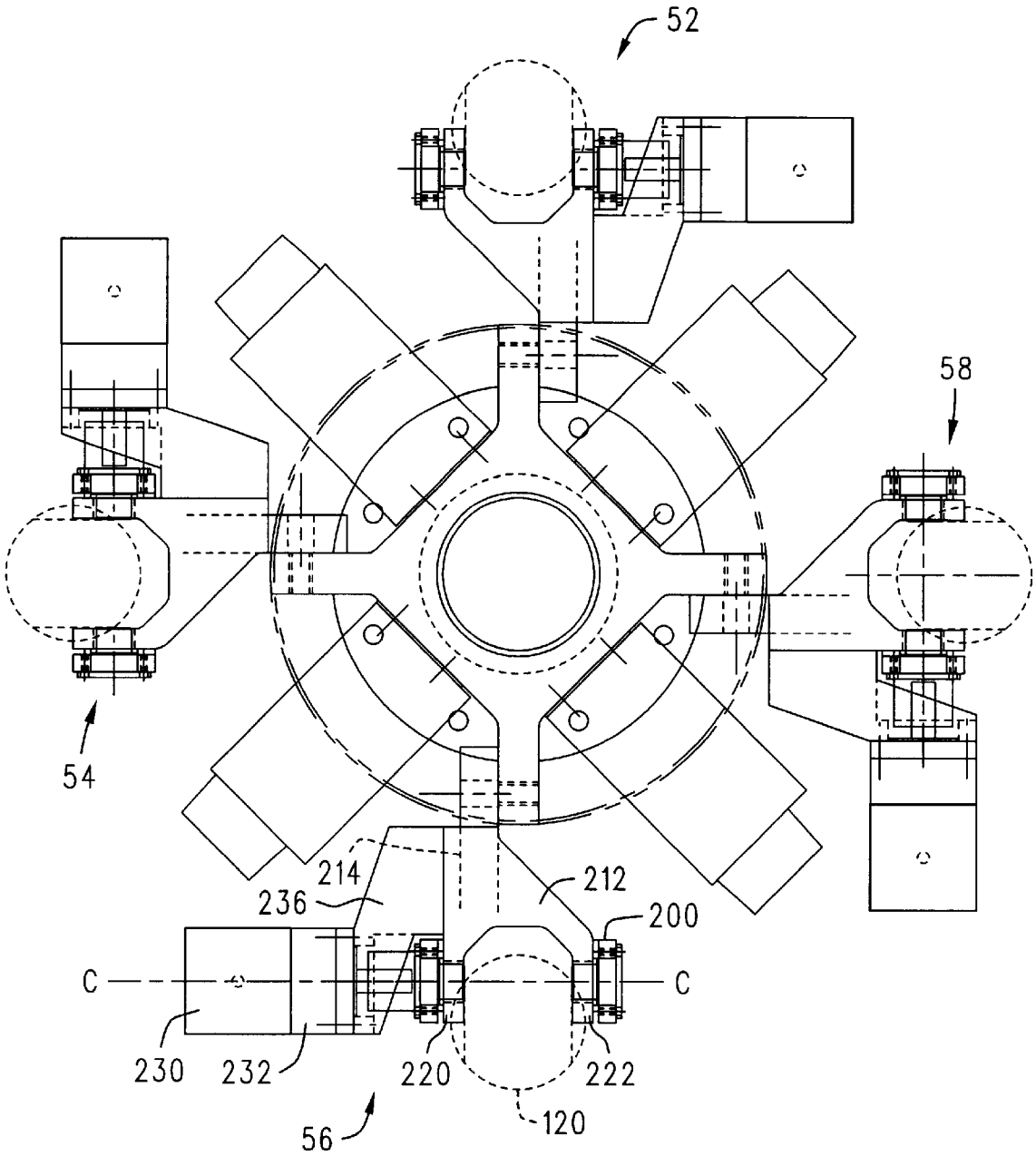
FIG. 2 is a top plan view of an upper turret assembly of the fluid dispensing system of FIG. 1.
Figure 3:
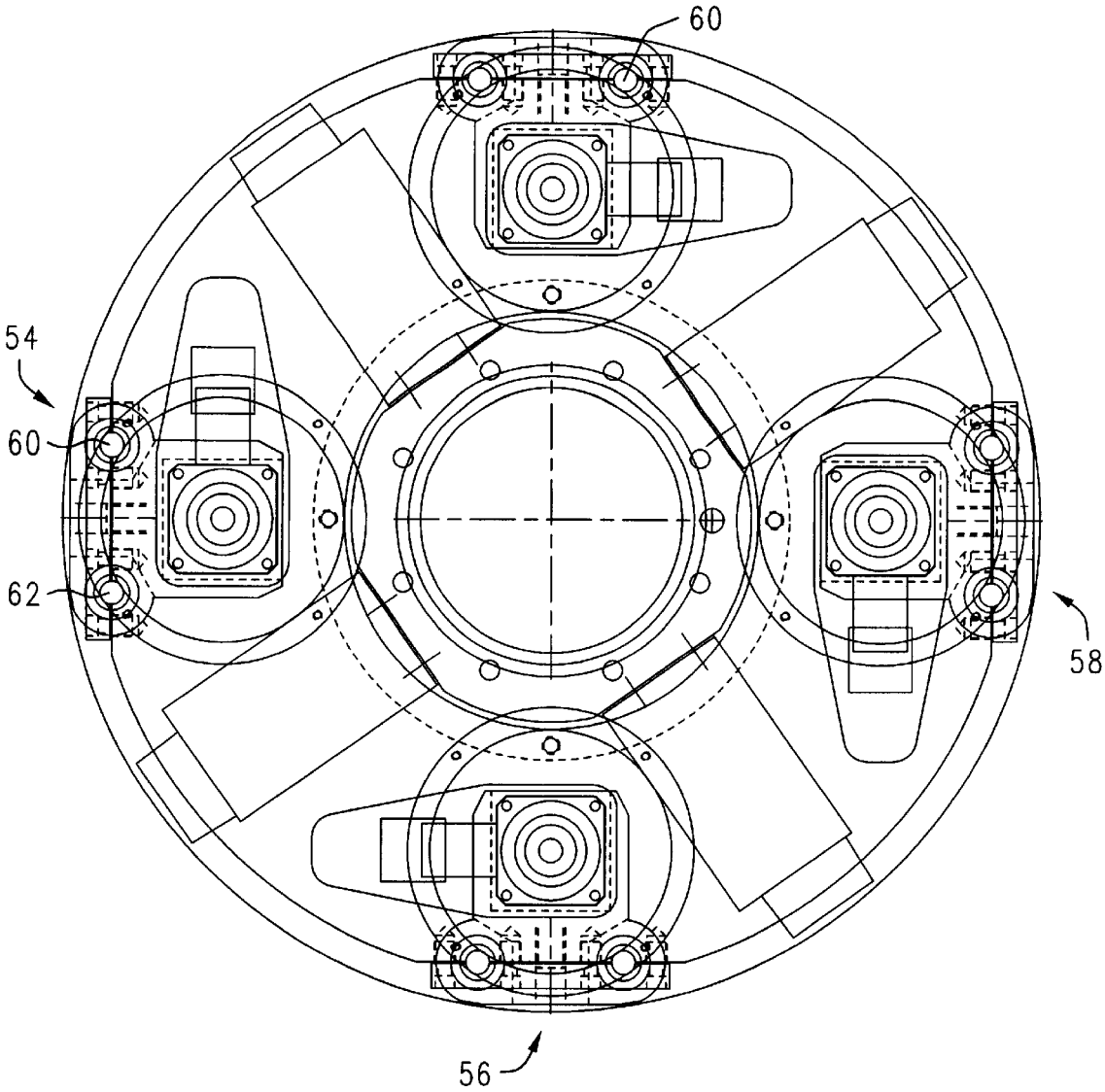
FIG. 3 is a top plan view of a lower turret assembly of the fluid dispensing system of FIG. 1.

Referring to FIGS. 2, 6 and 7, the pivotal mounting of the gun 120 will now be described in further detail. The gun 120 may be attached to a cradle member 200. A bracket 210 may include an upper portion 212 and a lower portion 214 as best shown in FIG. 6. Bracket lower portion 214 may be attached to the upper turret 16 via a pair of bolts 216, 218. Bracket upper portion 212 may include a pair of forwardly extending yoke members 220, 222 as best shown in FIGS. 2 and 7. Cradle member 200 may be pivotally attached to the yoke members 220, 222 via a pair of pivot pins 224, 226, respectively. As can be appreciated, mounted in this manner, the cradle 200 and, thus, the gun 120 is able to pivot about the axis C—C, FIG. 7 in the directions indicated by the arrows 124, 126, FIG. 6. Accordingly, the gun 120 is pivotally mounted to the upper turret 16. The axis C—C may be substantially perpendicular to the chuck rotational axis B—B, FIG. 4, and to the main turret rotational axis A—A, FIG. 1.

Referring, for example, to FIG. 7, a servo motor 230 may be attached to a right angle gear reducer 232 as shown. Right angle gear reducer 232, in turn may be attached to the bracket 210 via a connection bracket 236, FIGS. 2 and 7. In this manner, the servo motor 230 and gear reducer 232 are rigidly attached to the bracket 210 and, thus, to the upper turret 16. Referring again to FIG. 7, the output shaft 234 of the gear reducer 232 may be connected to a pivot coupling 238 which, in turn may be fixedly attached to the cradle 200. As can be appreciated, the arrangement described above allows the servo motor 230 to cause pivoting movement of the gun 120 about the axis C—C as previously described.

Servo motor 230 may be a conventional servo motor and may, for example, be of the type commercially available from Allen Bradley Company of 1201 S. Second Street, Milwaukee, Wis. 53204 and sold as Model No. Y-1002-1-H00AA. Gear box 232 may be a conventional right angle reduction gear box and may, for example, be of the type commercially available from CGI, Inc. of 3400 Arrowhead Drive, Carson City, Nev. 89706 and sold as Model No. NEMA17-18:1 Right Angle Gearhead.

Figure 8:
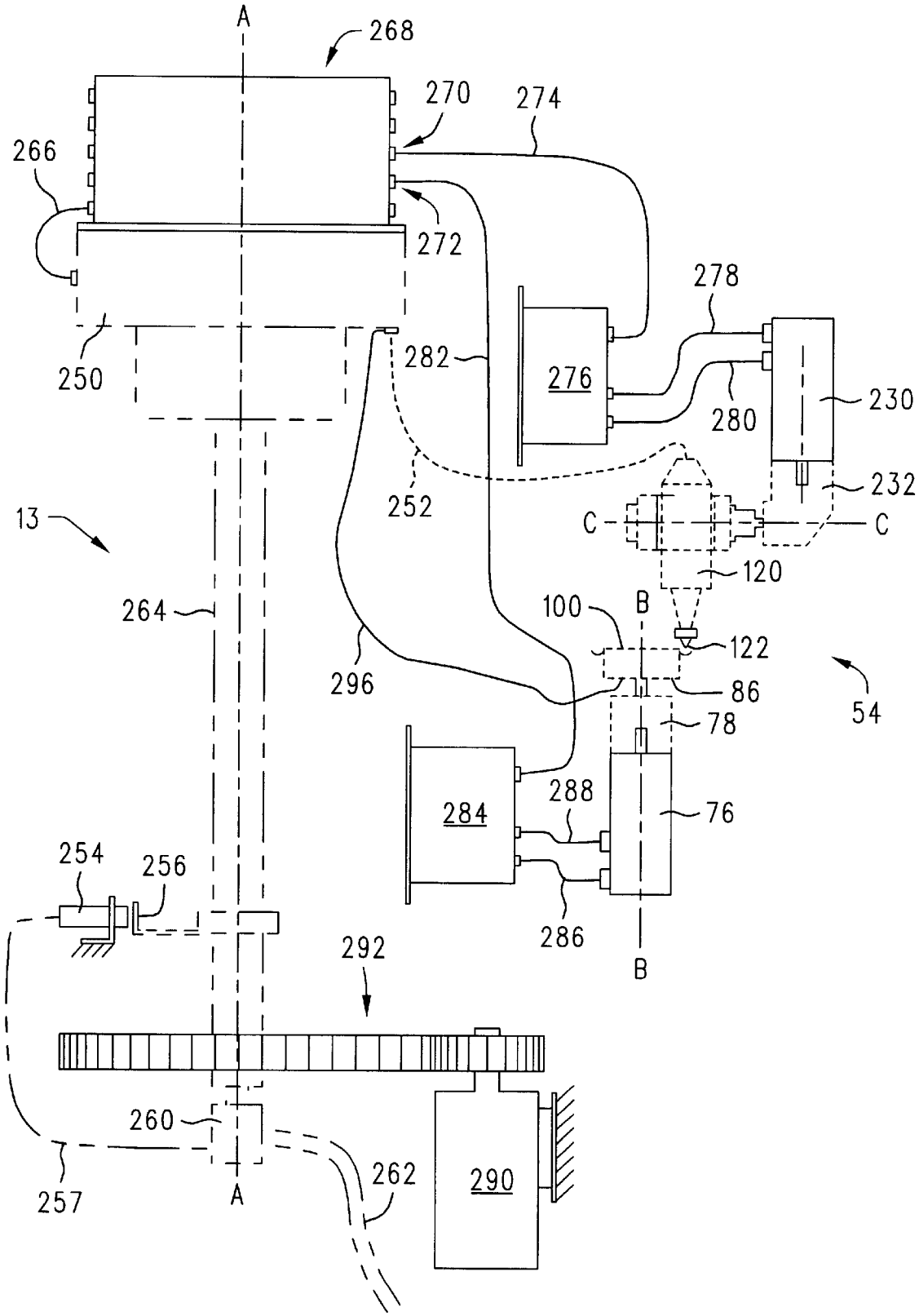
FIG. 8 is a view schematically illustrating the control of various components associated with the fluid dispensing system of FIG. 1.

FIG. 8 schematically illustrates the connection and control of the various components described above. Referring to FIG. 8, a main drive motor 290 may be drivingly attached to the main turret 13 via a series of gears 292 in a conventional manner. Accordingly, the motor 290 and gears 292 are able to cause rotation of the main turret assembly about the axis A—A.

Referring to FIG. 1, a controller 250 may, for example, be located as shown. Referring to FIG. 8, the controller 250 may be connected to the gun 120 via a connection 252, thus allowing the controller 250 to control the operation of the gun 120 (e.g., the starting and stopping of sealant dispensing) in a conventional manner. A proximity sensor 254 may be located as shown. A rotating proximity sensor target 256 may be located in proximity to the sensor 254 and may be attached to the system main turret assembly 13 such that it rotates therewith. Accordingly, the sensor 254 is able to determine the angular displacement of the main turret assembly about the axis A—A. A connection 257 may extend between the sensor 254 and an electrical rotary union device 260. A power supply connection 262 may also extend into the rotary union device 260 for the purpose of delivering power to the system. From the rotary union device 260, both the power connection 262 and the sensor connection 256 may extend upwardly through the shaft 264 to the controller 250. The controller 250 may be connected via a connection 266 to a plurality of motion controllers 268, such as the individual motion controllers 270, 272. One motion controller may be provided for each of the servo motors previously described.

Referring again to FIG. 8, a connection 274 may extend between the individual motion controller 270 and a servo motor controller 276. An encoder cable 278 may extend between the servo motor 230 and the motion controller 270 in order to supply a signal to the motion controller 276 indicating the angular position of the servo motor 230. A power cable 280 may extend between the motion controller 276 and the servo motor 230 in order to selectively supply power to the servo motor 230.

A connection 282 may extend between the individual motion controller 272 and a servo motor controller 284. An encoder cable 286 may extend between the servo motor 76 and the motion controller 284 in order to supply a signal to the motion controller 284 indicating the angular position of the servo motor 76. A power cable 288 may extend between the motion controller 284 and the servo motor 76 in order to selectively supply power to the servo motor 76.

A connection 296 may extend between the controller 250 and the electromagnet 86 in order to allow the controller 250 to selectively activate the electromagnet 86.

As can be appreciated from the above, the controller 250 is able to determine the angular displacement of the main turret assembly via the proximity sensor 254 and connection 257. Based upon this angular displacement information, the controller 250 may selectively activate the gun 120, the servo motors 76, 230 and the electromagnet 86 in a manner as will be described in further detail herein.

For explanatory purposes, the above connections have been described with respect to the station 54. It is to be understood that similar connections will exist for each of the stations 50 in the sealant dispensing system 10.

Figure 9:
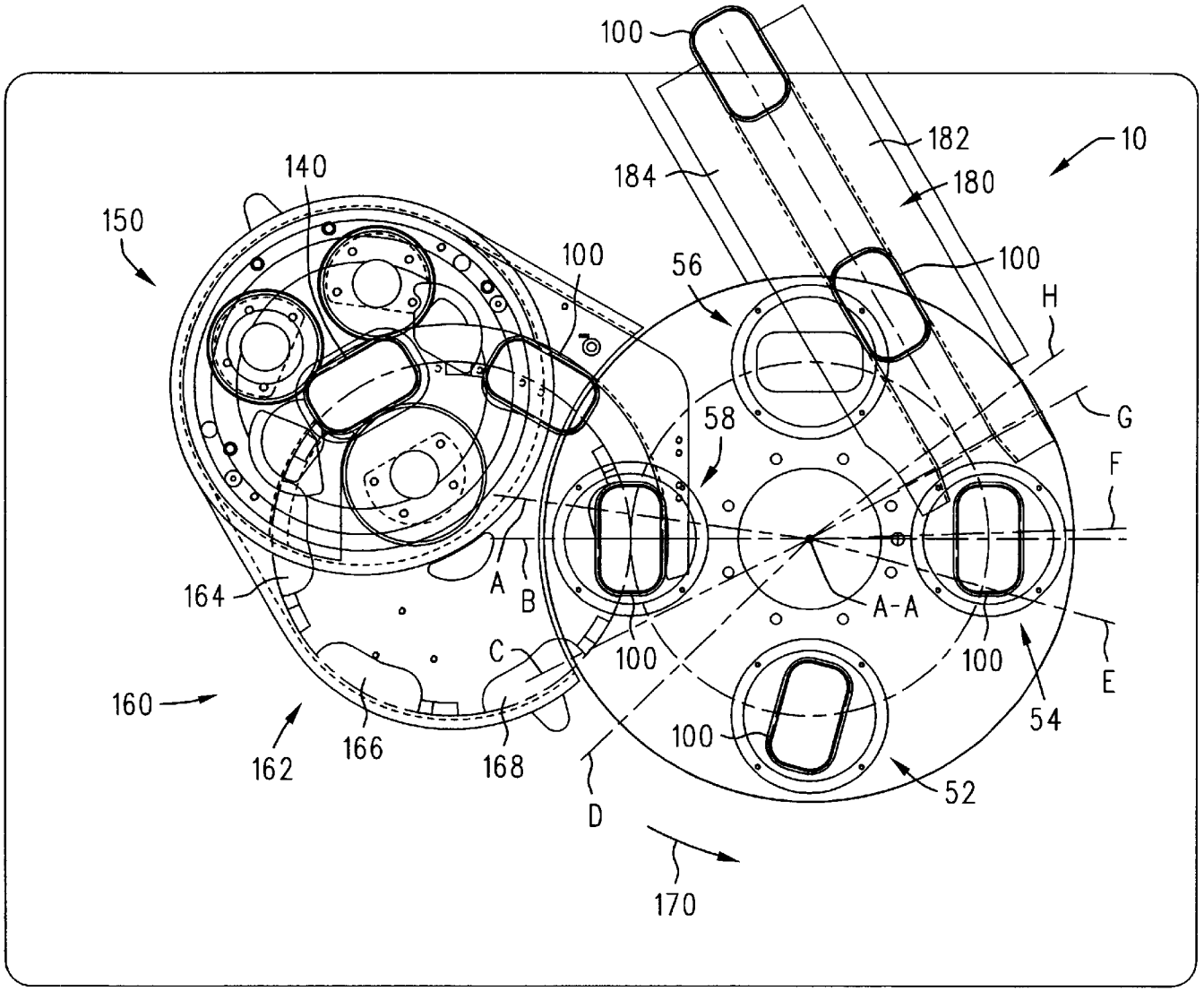
FIG. 9 is a view schematically illustrating the timing and operation of the fluid dispensing system of FIG. 1.

FIG. 9 schematically illustrates the operation and timing of the sealant dispensing system 10, as will now be described in detail.

Closure members 100 are brought into the sealant dispensing system 10 in a vertical stack 140 and enter a downstacker 150 which may, for example, be of conventional design. The downstacker 150 separates the bottom-most closure member 100 in the stack 140 and drops it into a rotatable starwheel mechanism 160. Starwheel mechanism 160 may include a plurality of pockets 162, such as the individual pockets 164, 166, 168. The pockets 162 may be sized and shaped to correspond to the size and shape of the closure members 100 being handled by the sealant dispensing system 10. Starwheel mechanism 160 may, for example, be of conventional design.

Continuing with the description of operation, the starwheel mechanism 160 moves a closure member 100 into alignment over the chuck 82, FIG. 4, of the station 58 as shown in FIG. 9. At the point of tangency, where the closure member 100 transfers from the starwheel mechanism 160 to the station 58, the chuck 82 will be flush with the top surface 19, FIG. 4, of the rotary table 18. At this point, the rotation of the chuck 82 will also be stopped in order to allow the loading of the closure member 100 onto the chuck 82. The use of a servo motor, e.g., the servo motor 76, FIG. 4, allows rotation of the chuck 82 to be stopped in this manner. Stopping chuck rotation is critical to the loading of non-circular closure members. Although circular closure members are conventionally loaded onto rotating circular chucks, it is not possible to load a non-circular closure member onto a rotating chuck. The servo motor may be instructed, by the system controller 250, FIG. 8, to stop the rotation of the chuck 82 such that the chuck 82 is aligned with the orientation of the closure member being transferred from the starwheel 160 as shown in FIG. 9.

After the closure member is loaded onto the chuck 82 of the station 58, as described above, continued revolution of the sealant dispensing system 10 about the axis A—A, will cause the station 58 to advance in the direction indicated by the arcuate arrow 170 in FIG. 9. This motion, in turn, will cause the chuck 82 of the station 58 to begin to rise and, thus, engage the closure member previously loaded. As previously described, this rise of the chuck 82 is caused by the interaction of a stationary cam 20 and revolving cam followers 72, 74, FIG. 4.

When the chuck 82 nears its fully raised position, the servo motor 76, e.g., FIG. 4, will be instructed by the system controller 250 to begin rotating the chuck. At this point, the servo motor 230, e.g., FIG. 6, will be instructed by the system controller 250 to begin pivoting the gun 120 about the axis C—C, thus, causing the gun opening 122 to follow the flange portion 102 of the closure member 100. Sealant material may then be dispensed from the gun 120 for about two full revolutions of chuck rotation.

As an example of operation, the chuck could make three full revolutions from start to stop. The first one-half revolution may allow for acceleration of the chuck to full speed. For the next two full revolutions, at full speed, sealant may be dispensed. The final one-half revolution may be for deceleration of the chuck 82 to a stop.

After sealant dispensing is completed, the chuck 82 will begin to lower to the level of the upper surface 19. When the chuck is fully lowered, the closure member may be removed from the non-rotating chuck 82 by an exit conveying device 180, FIG. 9, which may, for example, be of conventional design. Exit conveying device 180 may, for example, comprise a pair of guide rails 182, 184 as shown. As in the case of loading the closure member onto the chuck, it is also critical for proper unloading of a non-circular closure member that rotation of the chuck 82 first be stopped.

Referring to FIG. 9, the chuck 82 may, for example, begin rising at the rotational load point "A" and may continue to rise until it reaches its upward most extent at rotational point "C" which may, for example, be about 35 degrees past the load point "A". At the point "B", which may be about 8 degrees past the load point "A", the electromagnet 86 may be energized. At the point "C", the servo motor 76 may begin to accelerate the chuck 82 for a half rotation, as described above. This acceleration may continue for about 17.5 degrees past the point "C" until the point "D" is reached. Also at the point "C", the servo motor 230 is activated to cause the gun opening 122 to begin following the contour of the closure member flange 102. At the point "D", the servo motor 76 may begin two full speed rotations of the chuck 82. The gun opening 122 will continue to follow the contour of the flange 102 and sealant is dispensed from the gun. At the point "E", which may be about 120 degrees from the point "D", the servo motor 76 may begin to decelerate the chuck 82 and the dispensing of sealant from the gun will cease. The gun opening 122, however, will continue to follow the contour of the flange 102 until the point "F" is reached at which time the chuck will have completely stopped rotation. The point "F"0 may be about 17.5 degrees from the point "E". At the point "F", the chuck will begin to drop to its retracted position. Also, at the point "F", the gun opening 122 may stop following the contour of the closure member flange 102. At the point "G", which may be about 27 degrees from the point "F", the electromagnet 86 may be de-energized to facilitate unloading of the closure member. At the unload point "H", which may be about 8 degrees from the point "G", the chuck has reached its fully retracted position and the closure member may be unloaded by the exit conveying device 180.

The system controller 250 may be programmed to cause the servo motor 76 to accelerate, rotate a predetermined number of rotations at a predetermined speed, decelerate and stop. As previously described, each of the stations 50 has its own servo motor 76. The servo motor start/stop and other timing points described above may be controlled by the system controller 250 based upon an input signal 257, FIG. 8 from the proximity sensor 254. In this manner, the servo motors associated with each of the stations 50 may, in effect, be "slaved" to the main turret drive motor 290.

As previously described, an electromagnet 86 may be associated with each of the stations 50. Each of the electromagnets may be controlled by the system controller 250. The electromagnets may be used to hold closure members made, for example, of steel in place on the chucks 82. The electromagnets may be timed to be energized and de-energized at predetermined points of rotation of the main turret. The use of electromagnets, as described herein, has been found to have various advantages over the use of permanent magnets. The use of electromagnets, for example, facilitates loading of closure members onto the chuck 82. It has been found that using permanent magnets sometimes interferes with the loading of closure members in that the permanent magnet tends to drag the closure member and, thus, not allow it to properly align with the chuck before the chuck is lifted. It has been found that using permanent magnets also sometimes interferes with the unloading of closure members since the permanent magnets tend to keep the closure member stuck on the chuck. This, in turn, sometimes causes the closure members to jam beneath the exit conveying device guide rails 182, 184. The use of electromagnets overcomes these problems associated with permanent magnets because the electromagnets can be selectively turned on and off as described above.

As described above, the system controller 250 controls the rotation of the chuck 82 (via the servo motor 76) and the pivoting motion of the gun 120 (via the servo motor 230). The combination of these motions dictates the profile that the opening 122 of the gun 120 will follow. Accordingly, it is necessary to program the controller 250 for the specific size and shape of a particular closure member to be coated with the system 10. First, however, it is necessary to calculate the linear displacement required from the gun 120 relative to the rotation of the closure member and chuck 82.

Figure 10:
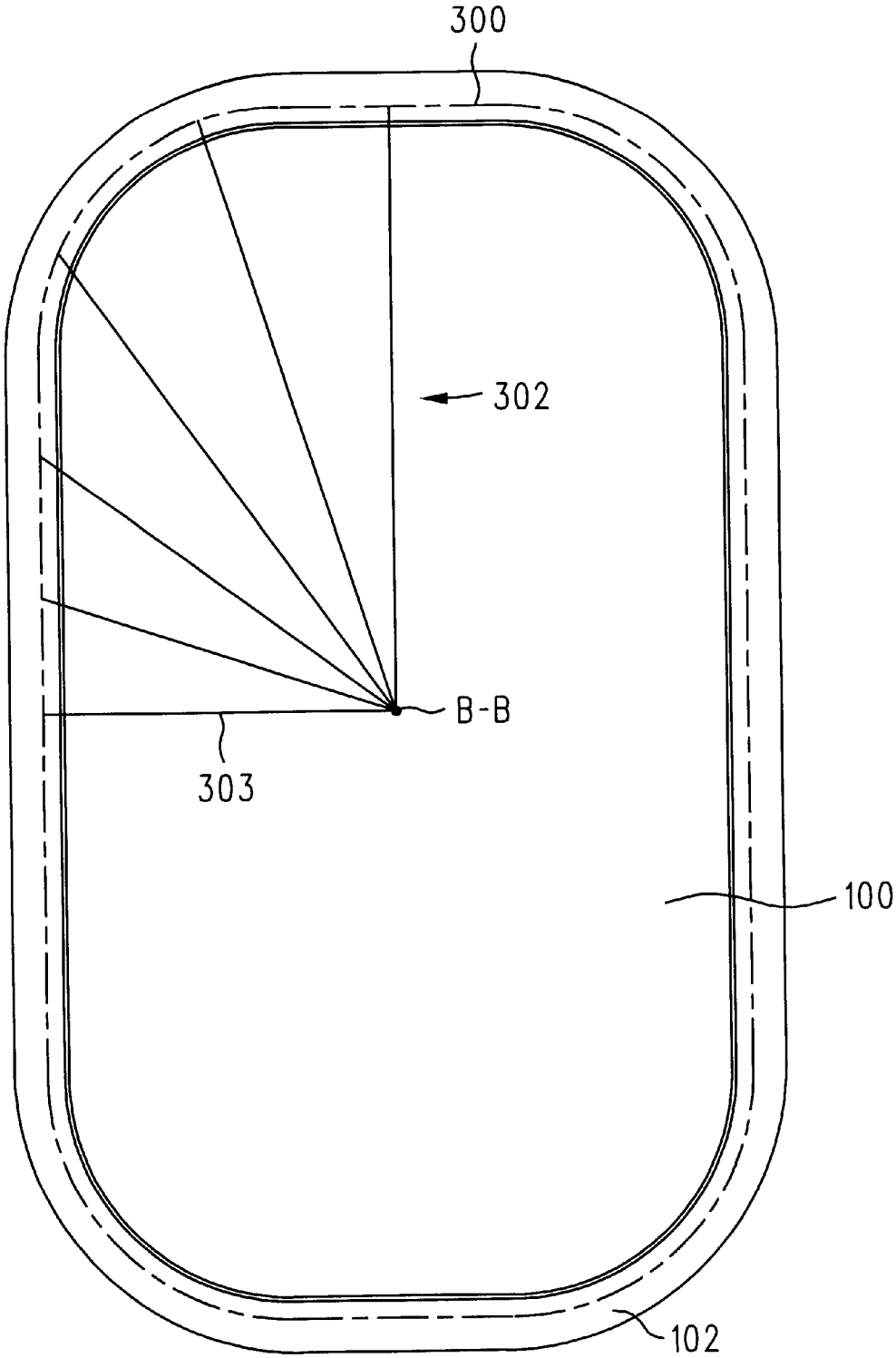
FIG. 10 is a view schematically illustrating how linear displacements may be calculated for a non-circular closure member.

FIG. 10 graphically illustrates how this calculation may be made for an exemplary closure member 100. FIG. 10 illustrates the closure member 100 having a flange portion 102, as previously described. The line 300 represents the desired center line of sealant to be applied to the flange 102. A plurality of lines 302 may be drawn from the center of the closure member, which may correspond to the axis B—B previously described, and the line 300. The lines 302 may, for example be drawn in one degree increments over a range of 90 degrees, although only a few lines are shown in FIG. 10 for illustration purposes. The line 303 may correspond to the zero degree rotational point of the chuck 82 for calculation purposes.

The length of each of the lines 302 represents the required linear displacement of the dispensing gun opening 122 relative to the center of the closure member for each degree of angular displacement of the chuck 82. The length of each of the lines 302 may be either measured or calculated as will be readily apparent to one skilled in the art. Once the length of each of the lines 302 is determined, a table may be generated relating angular displacement of the chuck 82 to the required linear displacement of the gun opening 122.

It is noted that the above length determination has been described using 1 degree increments for exemplary purposes only. Any other interval may alternatively be used in order to achieve the desired resolution. It is to be understood that linear displacements need only be calculated for 90 degrees of rotation since the closure member illustrated in FIG. 10 is symmetrical about two axes.

Figure 11:
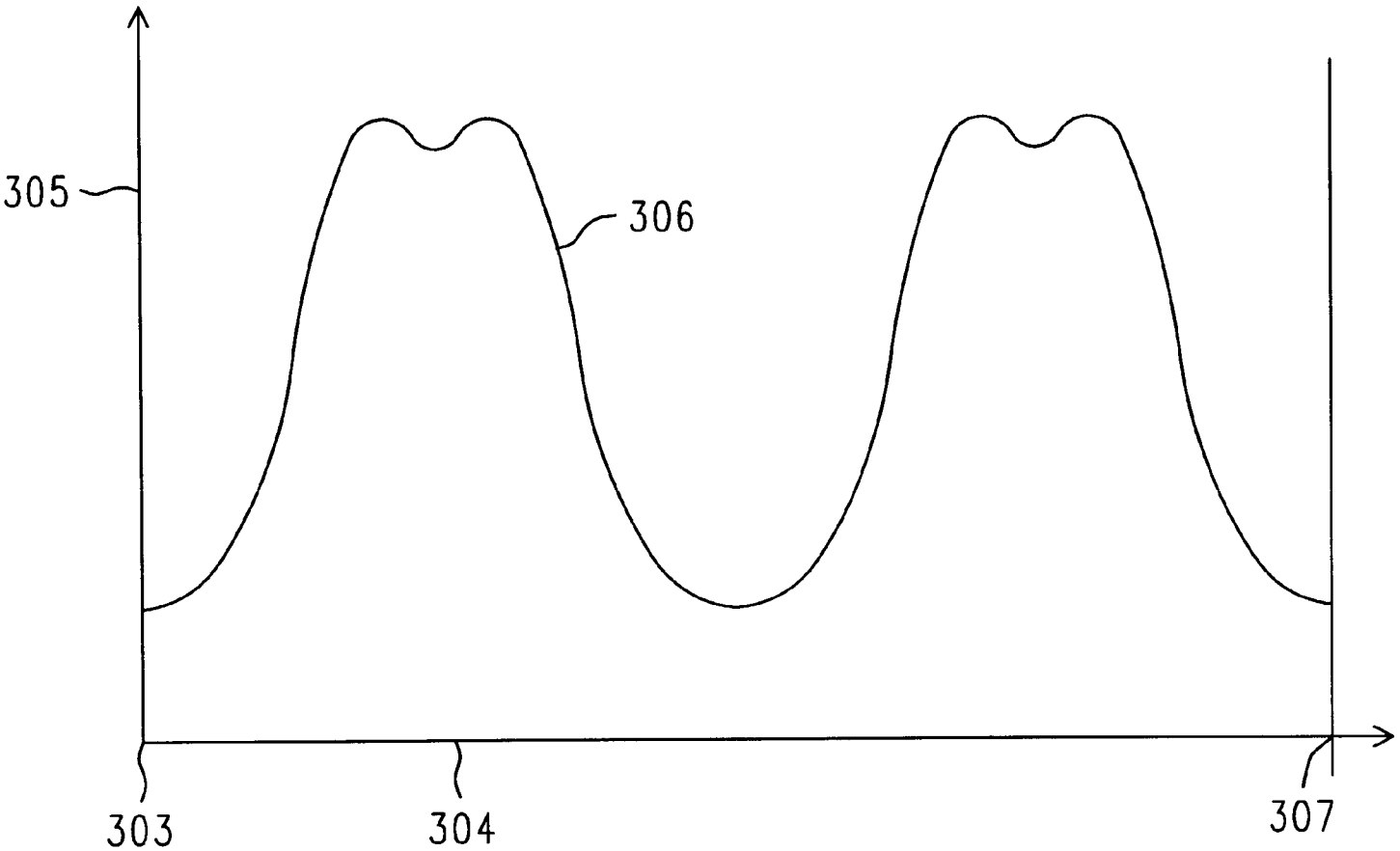
FIG. 11 is an exemplary graphical representation of dispensing gun opening linear displacement vs. chuck angular rotation.

FIG. 11 is a graphical illustration of the dispensing gun opening linear displacement vs. chuck angular displacement for the exemplary end illustrated in FIG. 10. Referring to FIG. 11, angular displacement of the chuck 82 about the axis B—B, FIG. 10, is measured along the x-axis 304 of the graph, with the point 303 corresponding to the zero degree rotational point of the chuck 82 and the point 307 corresponding to the 360 degree rotational point of the chuck 82. Linear displacement of the dispensing gun opening 122 from the axis B—B, FIG. 10, is measured along the y-axis 305 of the graph of FIG. 11. Accordingly, the line 306 graphically illustrates the linear displacement of the dispensing gun opening 122 relative to the angular displacement of the chuck 82.

Using conventional trigonometric practices, the dispensing gun opening linear displacement information, as illustrated, for example, in FIG. 11, can be used to calculate the required angular displacement of the gun 120 about the axis C—C, FIG. 6, relative to the angular displacement of the closure member 100 about the axis B—B. As can be appreciated, this information can readily be used to program the controller 250 with respect to the closure member 100.

With the exception of the improvements described herein, the structure and operation of the sealant dispensing system 10 may, for example, be substantially identical to that described in U.S. Pat. Nos. 4,262,629; 4,840,138; 5,215,587; or 5,749,969, previously referenced.

Figure 12:
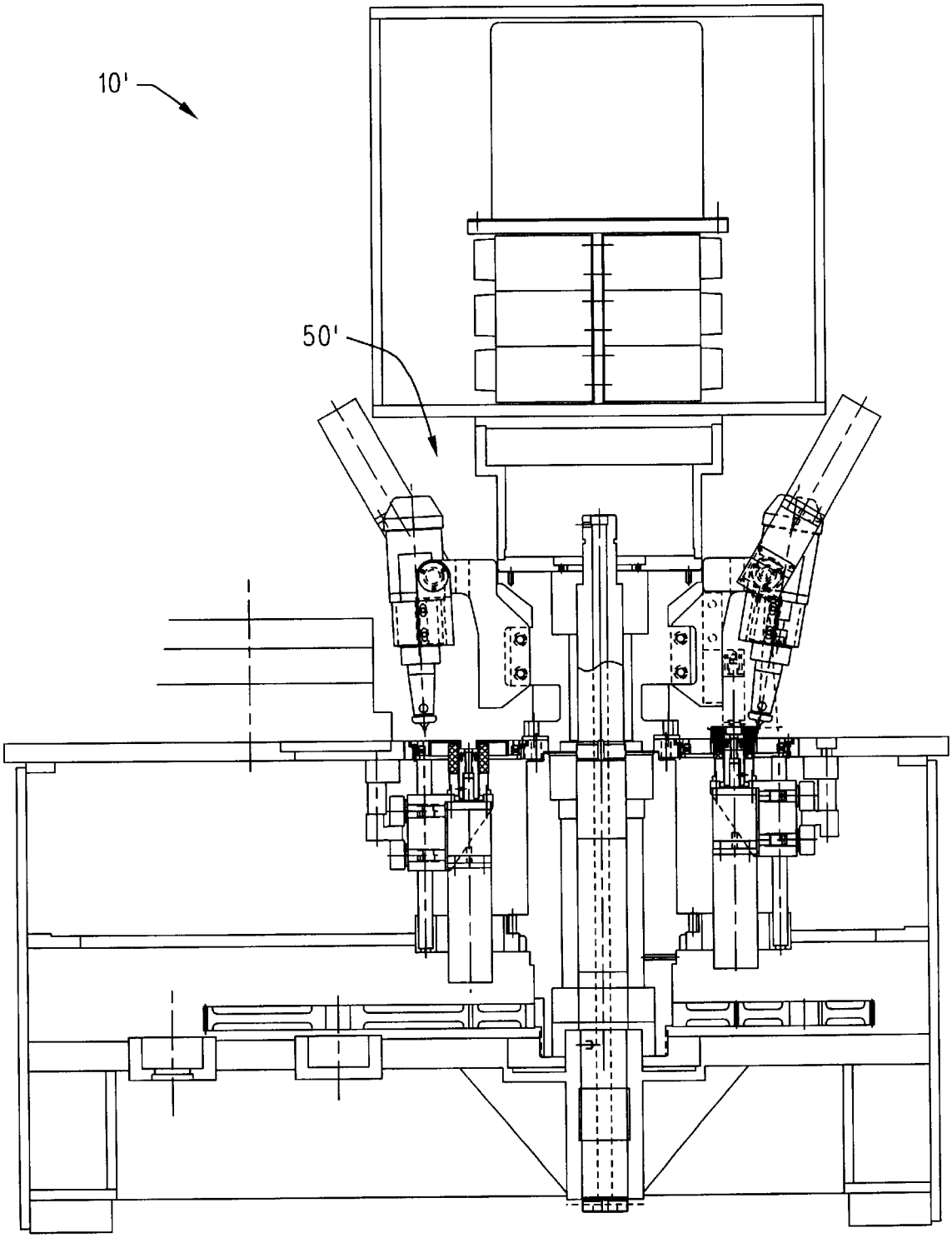
FIG. 12 is a partial cross-sectional elevation view of a fluid dispensing system having six stations.
Figure 13:
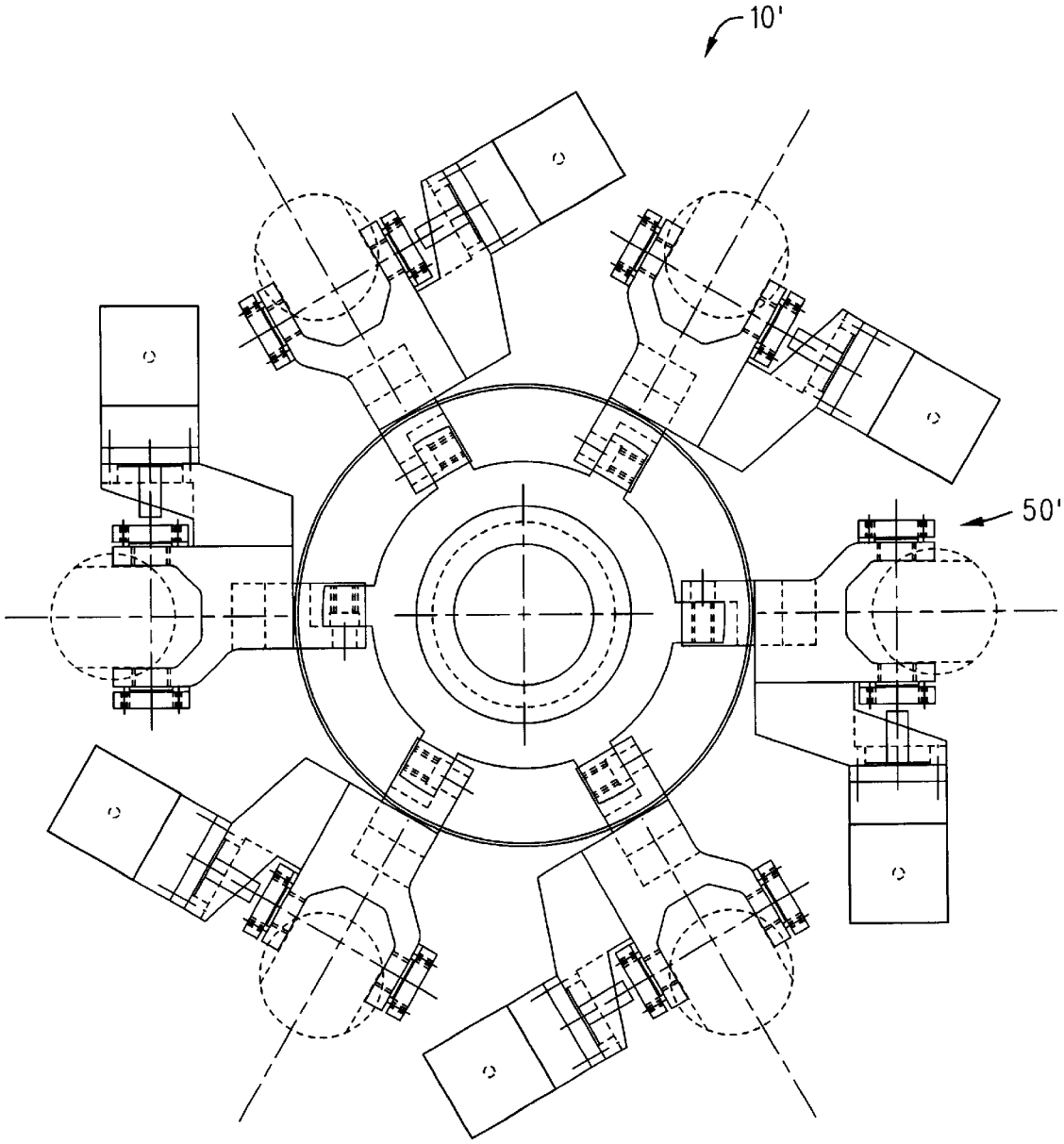
FIG. 13 is a top plan view of an upper turret assembly of the fluid dispensing system of FIG. 12.
Figure 14:
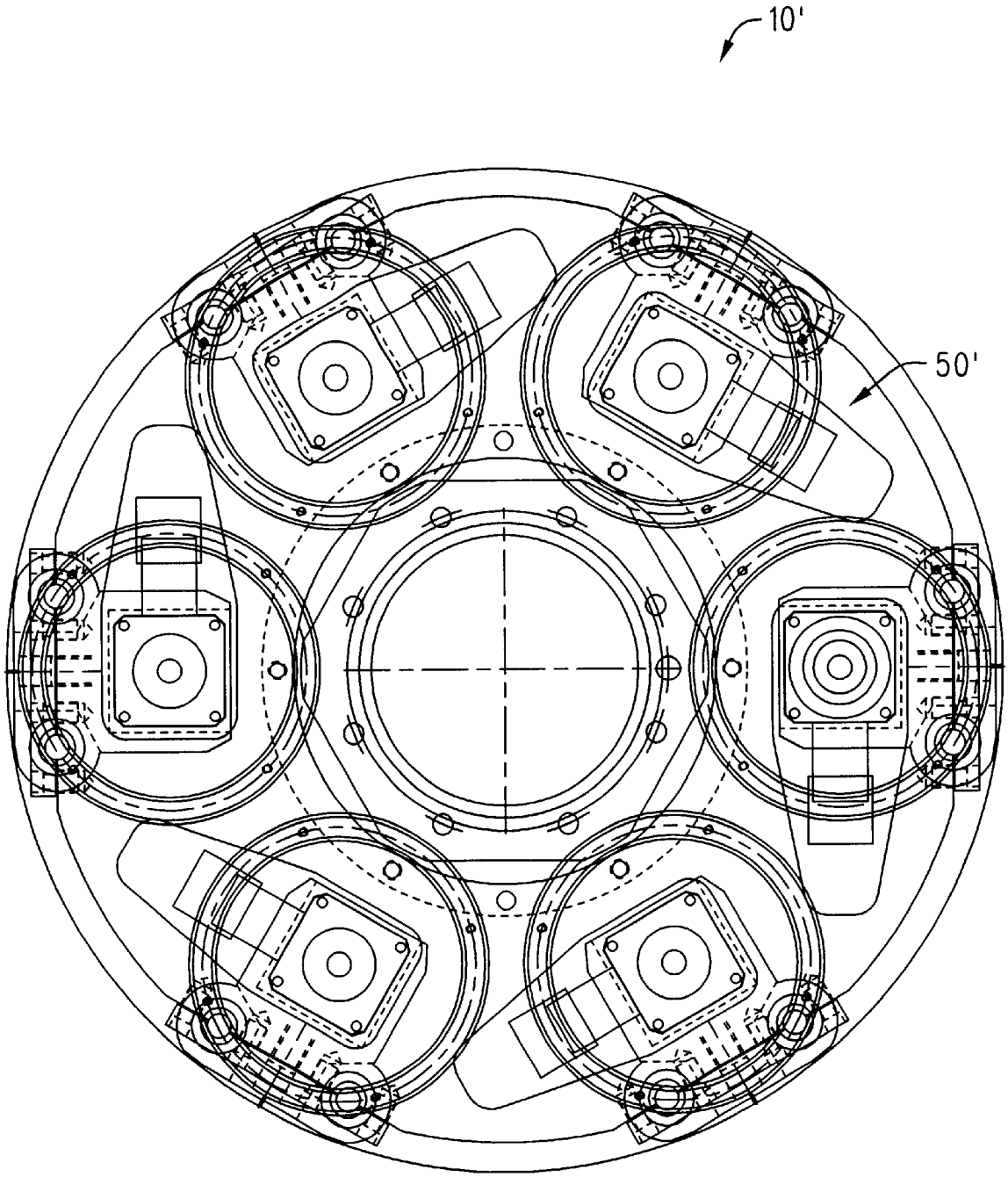
FIG. 14 is a top plan view of a lower turret assembly of the fluid dispensing system of FIG. 12.

It is noted that the sealant dispensing system 10 has been described herein as having four stations for exemplary purposes only. The sealant dispensing system 10 could, alternatively have any number of stations. FIGS. 12–14, for example, illustrate a sealant dispensing system 10' having six stations 50'. Other than the number of stations, the system depicted in FIGS. 12–14 may be substantially similar to that of FIGS. 1–3.

It is noted that the sealant dispensing system 10 may also be used in a single station, indexing machine. An example of such an indexing machine is the type commercially available from WR Grace Company of Lexington, Mass. and sold as a "D&A Mark 70" model.

Figure 16:
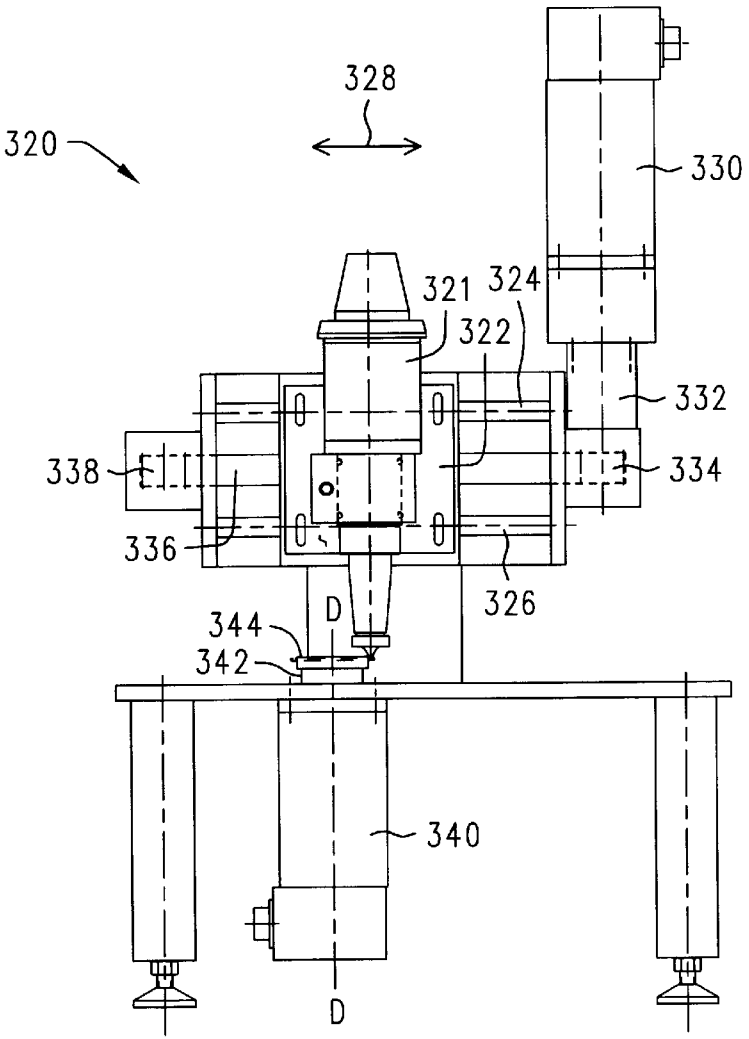
FIG. 16 is a front elevation view of the fluid dispensing system of FIG. 15.
Figure 15:
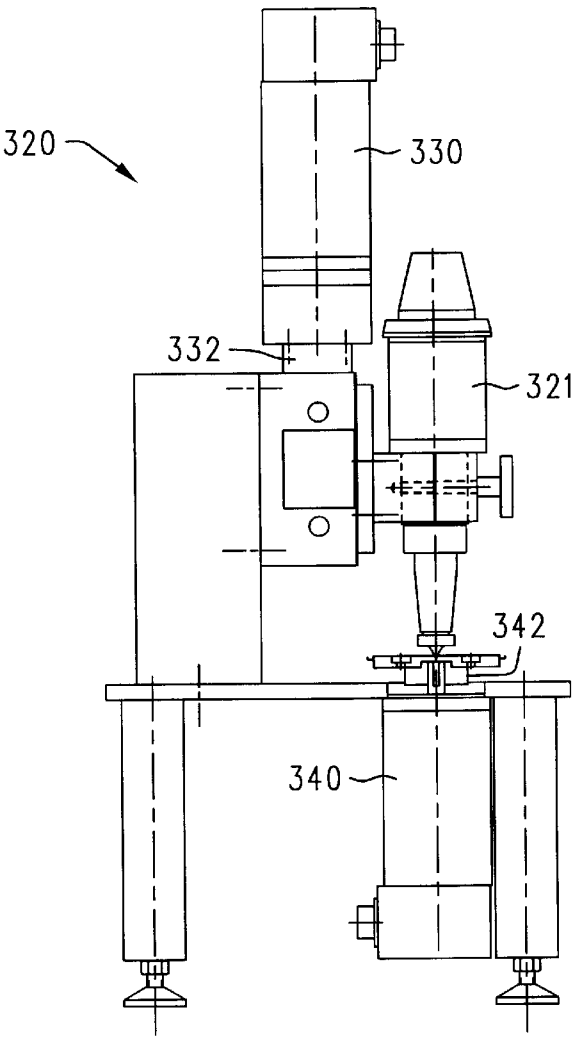
FIG. 15 is a side elevation view of a fluid dispensing system having a gun which moves in a linear fashion.

The sealant dispensing system 10 has been described herein having a pivoting gun 120. The system could, however, instead use a gun which moves in a linear fashion. FIGS. 15 and 16 illustrate a translational or linear motion gun sealant dispensing system 320. Referring now to FIGS. 15 and 16, a gun 321 may be mounted on a carriage 322. The gun 321 may be substantially identical to the gun 120 previously described herein. The carriage 322 may be mounted on a pair of guide rails 324, 326 such that the carriage 322 and attached gun 321 are able to move in the linear directions indicated by the arrow 328 in FIG. 17. A servo motor 330 may be attached, via a reduction gearbox 332, to a drive pulley 334. A timing belt 336 may be engaged around the drive pulley 334 and an oppositely disposed pulley 338. As can be appreciated, actuation of the servo motor 330 will cause the gun 321 to move in the linear directions 328.

A servo motor 340 may be attached to a chuck 342 which is adapted to receive a non-circular closure member 344. Closure member 344 may, for example, be substantially identical to the closure member 100 previously described. As can be appreciated, activation of the servo motor 340 will cause the chuck 342 and the closure member 344 to rotate about the rotational axis D—D.

In this manner, the system 320 is capable of applying sealant to non-circular closure members in a similar manner to the system 10 previously described. Specifically, the combination of rotational movement about the axis D—D and linear movement in the directions 328 allows the gun 321 to coat closure members of any shape.

The linear motion system 320 may, in all other respects operate in a substantially similar manner to that described above with respect to the system 10 and may, for example, be used in either a multiple (e.g, four or six) station rotary machine or in a single station indexing machine.

The pivoting gun variation previously described is advantageous relative to the linear motion gun variation in that, in the pivoting gun variation, less force is required to move the gun since the pivot point C—C is chosen to pass through the approximate center of gravity of the gun. In the linear gun variation, a large mass must be moved over a relatively large distance.

The linear motion gun variation, however, is advantageous in that the gun opening does not move in an arcuate fashion and, thus, the dispensing angle of the gun remains constant relative to the closure member.

Figure 17:
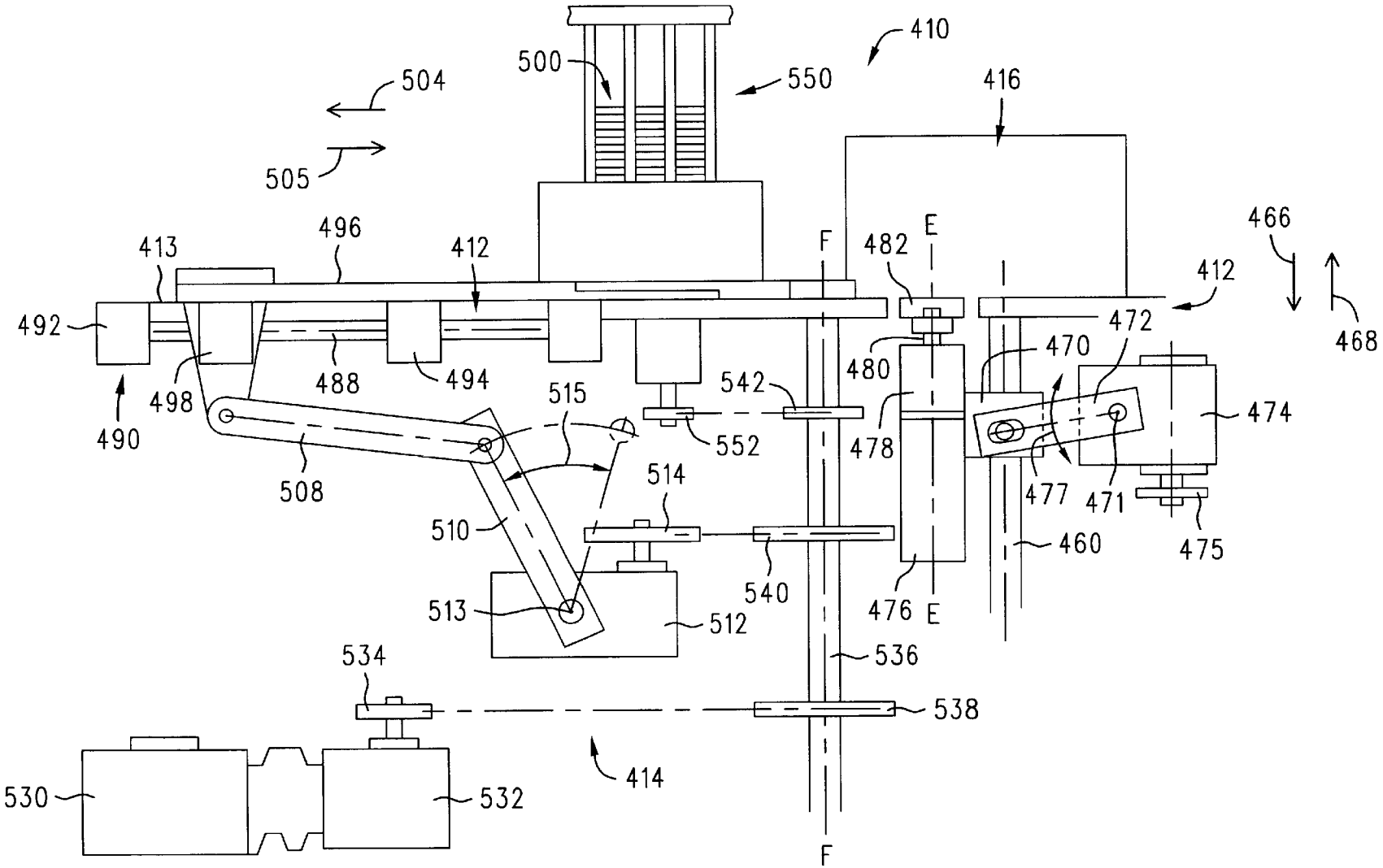
FIG. 17 is a schematic illustration of an indexing type fluid dispensing system.

FIG. 17 schematically illustrates a further indexing type sealant dispensing system 410. Sealant dispensing system 410 may include a support structure 412. A lower assembly 414 and an upper assembly 416 may be attached to the support structure 412.

Lower assembly 414 will now be described in further detail. With reference to FIG. 17, lower assembly 414 may include a pair of guide rods (only the guide rod 460 is visible in FIG. 17) which may be fixedly attached to the support structure 412. A carriage 470 may be slidingly attached to the guide rods for reciprocal movement in the directions 466, 468. The carriage 470 may be attached, via a drive arm 472 to a cam box 474 at a rotation point 471. Cam box 474 may include an input gear 475 as shown.

A servo motor 476 and a reduction gear box 478 may be mounted to the carriage 470 as shown. The servo motor 476 and gear box 478 may be arranged in a conventional manner such that the output shaft of the servo motor 476 engages with the input drive of the gear box 478. An output shaft 480 of the gear box 478 may be attached to a chuck 482 as shown. As can be appreciated, activation of the servo motor 476 will, through the reduction gear box 478, cause rotation of the chuck 482 about the rotational axis E—E.

Servo motor 476 may be a conventional servo motor similar to the servo motor 76 described previously. Servo motor 476 may, for example, be of the type commercially available from Allen Bradley Company of 1201 S. Second Street, Milwaukee, Wis. 53204 and sold as Model No. N-2304-1-F00AA. Gear box 478 may be a conventional reduction gear box similar to the reduction gear box 78 previously described. Gear box 478 may, for example, be of the type commercially available from CGI, Inc. of 3400 Arrowhead Drive, Carson City, Nev. 89706 and sold as Model No. NEMA23-9:1 Planetary Gearhead.

Chuck 482 may be configured to receive a closure member, such as the closure member 100, previously described. Chuck 482 may, for example, be substantially identical to the chuck 82 previously described.

Referring again to FIG. 17, in operation, rotation of the input gear 475 of the cam box 474 will cause the drive arm 472 to rotate about the rotation point 471 in the directions indicated by the arrow 477. This movement, in turn, will cause the carriage 470 (along with the attached servo motor 476, gear box 478 and chuck 482) to move along the guide rod 460 in the directions 466, 468. The drive arm 472 may, for example, rotate through about 10 degrees of movement. This exemplary 10 degree movement of the drive arm 472 will result in a translational movement of the carriage 470 (and the attached servo motor 476, gear box 478 and chuck 482) of about 0.44" in the directions indicated by the arrows 466, 468.

The sealant dispensing system 410 may also include a downstacker device 550 which is driven by an input gear 552, as shown. In operation, the downstacker device 550 serves to feed closure members, such as the closure member 500 schematically illustrated in FIG. 17, to the upper surface 413 of the support structure 412.

Figure 18:
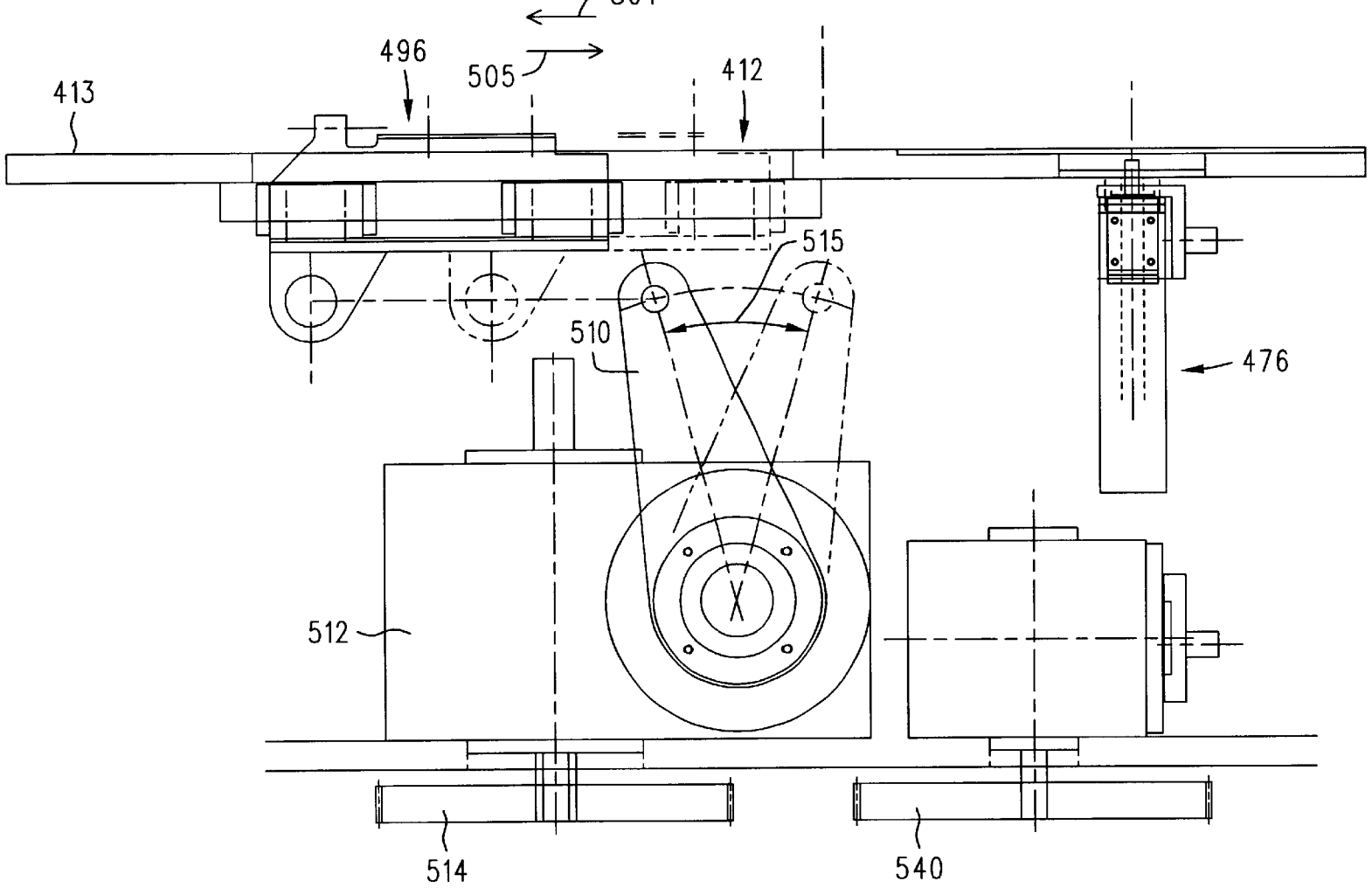
FIG. 18 is an enlarged view of a portion of the indexing type fluid dispensing system of FIG. 17.

With reference to FIGS. 17 and 18, lower assembly 414 may further include a pair of guide rods (only the guide rod 488 is visible in FIG. 17) which may be fixedly attached to the support structure 412 via a plurality of support blocks 490, such as the individual support blocks 492, 494. A carriage 498 may be slidingly attached to the guide rods for reciprocal movement in the directions 504, 505. The carriage 498 may be attached, via a link arm 508 and a drive arm 510 to a cam box 512 at a rotation point 513. Cam box 512 may include an input gear 514 as shown.

A shuttle mechanism 496 may be mounted to the carriage 498 as shown, for example, in FIG. 17. In operation, rotation of the input gear 514 of the cam box 512 will cause the drive arm 510 to rotate about the rotation point 513 in the directions indicated by the arrow 515. This movement, in turn, will cause the carriage 498 (which is connected to the drive arm 510 via the link arm 508), along with the attached shuttle mechanism 496, to move along the guide rod 488 in the directions indicated by the arrows 504, 505. The drive arm 515 may, for example, rotate through about 30 degrees of movement. This exemplary 30 degree movement of the drive arm 472 will result in a translational movement of the carriage 470 (and the attached shuttle mechanism 496) of about 5.56" in the directions indicated by the arrows 504, 505.

With reference, again to FIG. 17, lower assembly 414 may also include a motor 530, operatively attached to a gearbox 532. Gearbox 532 may include an output gear 534 as shown. Lower assembly 414 may further include a drive shaft 536 which is rotatable about an axis F—F. Drive shaft 536 may include an input gear 538, a first output gear 540 and a second output gear 542. Drive shaft input gear 538 may be operatively engaged with the output gear 534 of the gearbox 532. In this manner, the motor 530 and gearbox 532 may serve to rotatably drive the drive shaft 536 about the axis F—F. First output gear 540 of the driveshaft 536, in turn, may be operatively engaged with the input gear 475 of the cam box 474 and with the input gear 514 of the cambox 512. The second output gear 542 of the driveshaft 536 may be operatively engaged with the input gear 552 of the downstacker 550. In this manner, the driveshaft 536 serves to drive the cambox 474, the cambox 512 and the downstacker 550, in a manner as previously described.

In operation of the lower assembly 414, each forward movement of the shuttle mechanism 496 (i.e., movement in the direction 505) serves to move a single closure member from the downstacker 550 to a position directly overlying the chuck member 482. The chuck member 482 is then raised (via the cam box 474 as described above), causing the closure member to be loaded onto the chuck member. Thereafter, the chuck member is rotated about the axis E—E (via the servo motor 476 and gearbox 478) and sealant is applied to the closure member by a sealant dispensing gun located in the upper assembly 416, as will be described in further detail herein. After the closure member is loaded onto the chuck member 482, the shuttle mechanism may move rearwardly (i.e., in the direction 504) to secure the next uncoated closure member from the downstacker 550. After the previous closure member has been coated and discharged from the chuck 482, the shuttle mechanism moves the next closure member into place on the chuck, thus beginning the cycle again. Because of its cyclical nature (e.g., the starting and stopping of the shuttle 496), the above type of operation is generally referred to in the industry as an indexing operation. The apparatus illustrated in FIG. 17, thus, is known as an indexing machine. This is in contrast to a rotary or continuous motion machine, such as that illustrated in FIGS. 1–9 and 12–14.

It is noted that, although the indexing system 410 of FIGS. 17 and 18 has been illustrated as a single lane system for purposes of illustration and description, the system 410 could readily be configured as a multi-lane system in which a plurality of dispensing guns are provided in side-by-side relationship.

Figure 26:
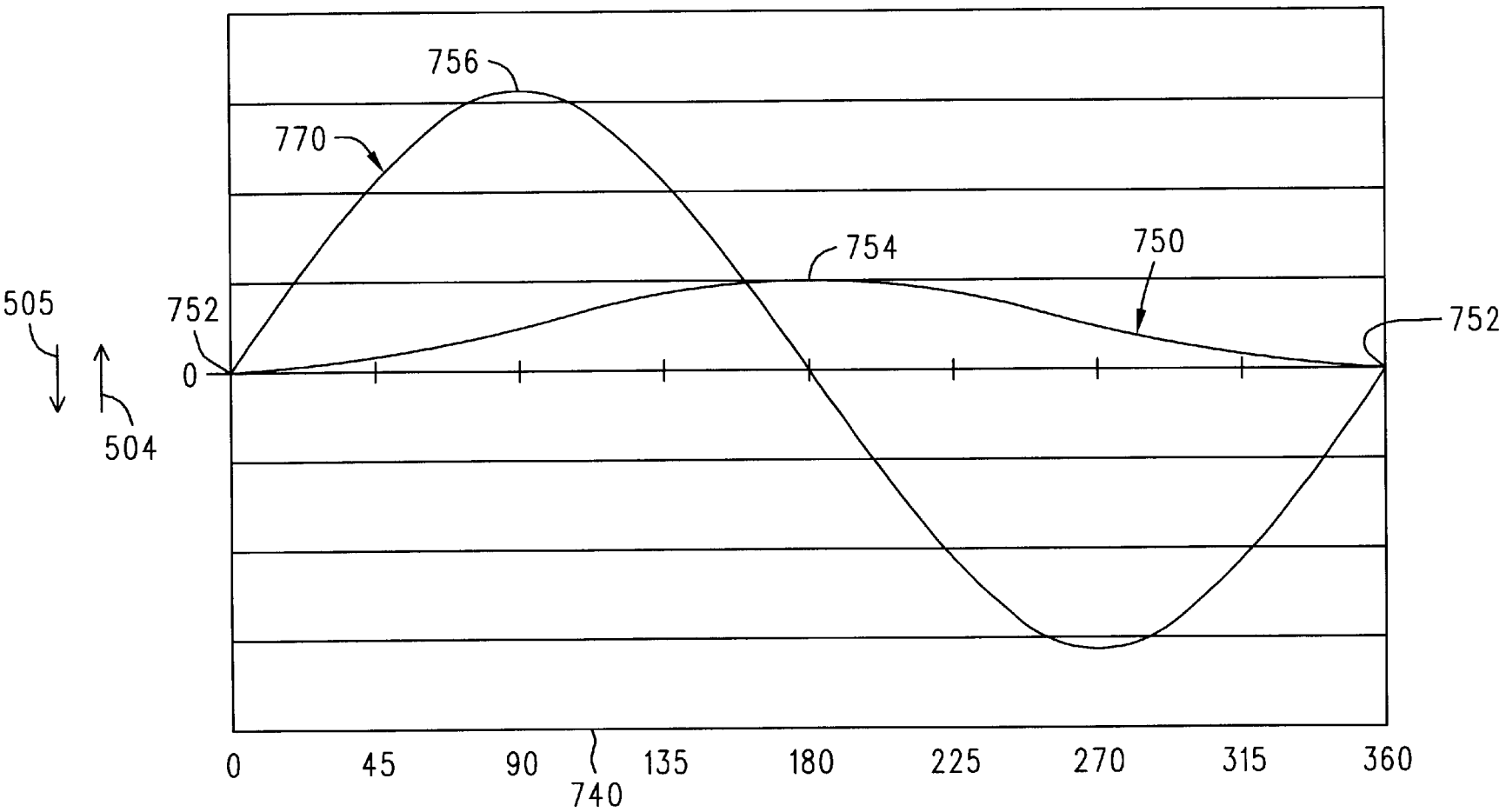
FIG. 26 PRIOR ART
FIG. 26 is a graph illustrating the movement of a conventional crank-driven shuttle mechanism.

The shuttle mechanism of a conventional indexing machine is typically driven by a crank mechanism which, in turn, is driven by the main drive unit of the machine. It has been found that the use of such a crank mechanism limits the speed at which closure members can be loaded by the shuttle mechanism onto the chuck member for coating. FIG. 26 illustrates motion characteristics for a typical crank driven shuttle mechanism. Referring to FIG. 26, crank rotation (in degrees) is illustrated on the x-axis 740. The line 750 indicates the linear displacement of the shuttle mechanism in the directions 504, 505, FIG. 17, versus crank rotation. The line 770 indicates the linear velocity of the shuttle mechanism in the directions 504, 505 versus crank rotation.

Referring again to FIG. 26, at a point 752, crank rotation is equal to zero degrees and the shuttle is in its fully retracted position. Accordingly, at this point, shuttle displacement 750 is equal to zero. At a point 754 (where the crank has rotated 180 degrees), the shuttle is at its fully extended position. It is at this shuttle position that a closure member may be loaded onto the chuck of the sealant dispensing machine. The point 754, thus, represents the point of maximum displacement of the shuttle in the direction 504. As the crank continues to rotate to 360 degrees, the shuttle returns to its fully retracted position 752.

As can be appreciated, as the shuttle initially begins to move from its fully retracted position 752, shuttle velocity 770 is very low. Shuttle velocity 770 reaches its maximum value at a point 756 where crank rotation is equal to 90 degrees. This point 756 is also the point at which the shuttle has traveled half way between its fully retracted position 752 and its fully extended position 754. As the shuttle moves from the half way point 756 to the fully extended position 754, shuttle velocity 770 begins to decrease, until it reaches zero at the fully extended position 754.

As can be appreciated from the above description, and with reference to FIG. 26, the shuttle moves at its maximum velocity 756 for only an instant during its movement. Accordingly, the average velocity of the shuttle is relatively low. This is disadvantageous because it limits the overall speed at which closure members can be processed. The present sealant dispensing system 410 overcomes this disadvantage by driving the shuttle mechanism 496 with a cam box 512, rather than a crank device.

Figure 27:
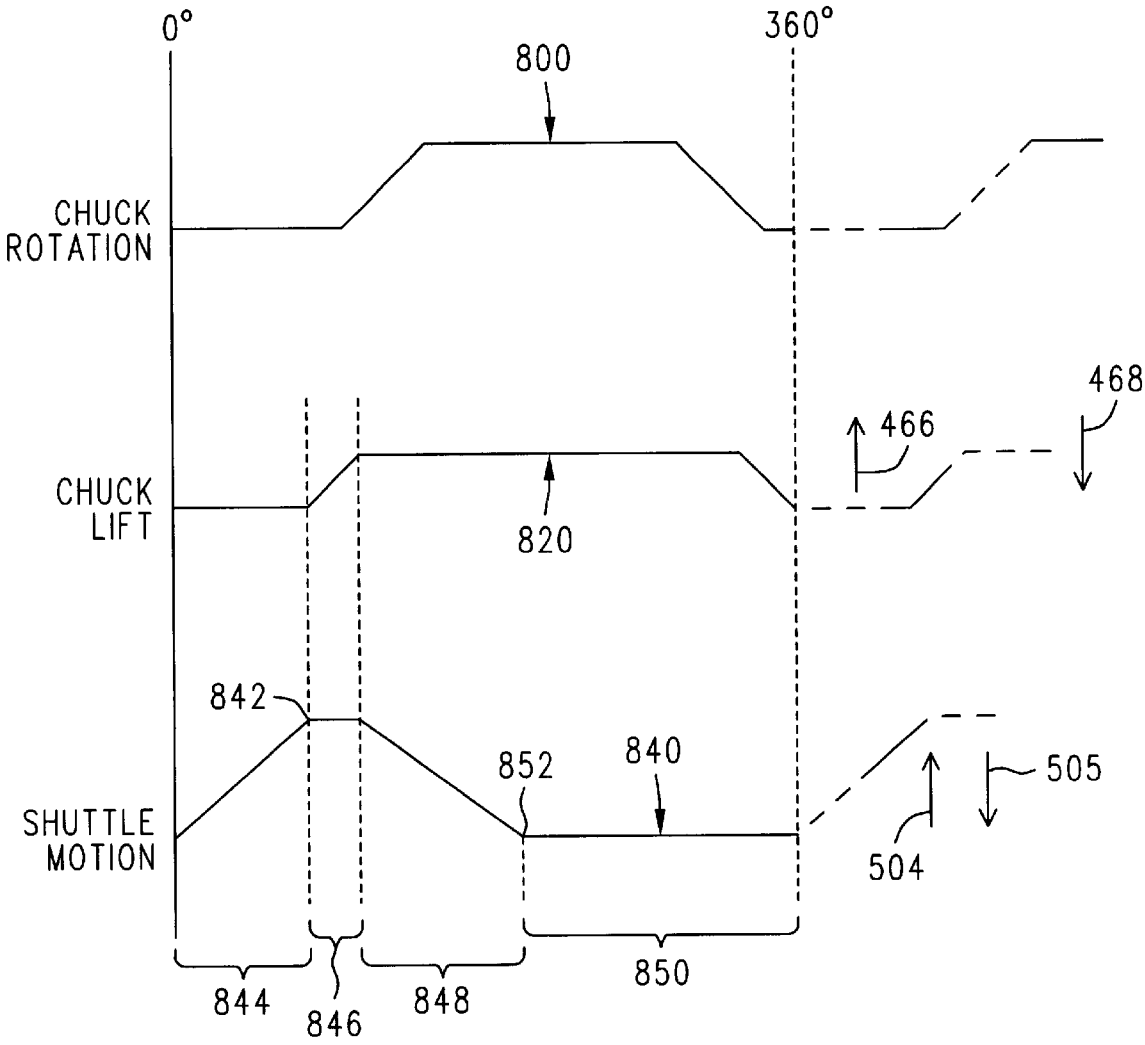
FIG. 27 is schematic illustration graphically representing the movement of an improved cam-driven shuttle mechanism.

FIG. 27 illustrates the movement characteristics of the shuttle mechanism 496 over 360 degrees of rotation. Specifically, the line 800 illustrates the rotation of the chuck member 482. The line 820 illustrates the lift of the chuck 482 in the directions 466, 468, FIG. 17. The line 840 illustrates the displacement of the shuttle in the directions 504, 505 in a manner similar to the line 750 of FIG. 26. As can be seen, with reference to the line 840, the shuttle 496 moves forward, in the direction 504, in a rapid manner, reaching its fully extended position 842 in just 73 degrees of rotation. Accordingly, the entire forward stroke 844 of the shuttle 496 takes much less time than in a crank driven system. After completing its forward stroke, the shuttle mechanism 496 may dwell for a period 846 in the forward position. Thereafter, the shuttle mechanism 496 may move in the opposite direction 505 for a period 848 until it reaches its fully retracted position 852. The shuttle mechanism may then dwell in the retracted position for a period 850. As can be appreciated, this operation of the shuttle mechanism reduces the time required to load a closure member onto the chuck member 482 and, thus, decreases the overall cycle time to process a closure member.

The advantageous operation of the shuttle mechanism described above is enabled by the use of the cam box 512 in place of a conventional crank mechanism. The particular profile of the cam contained within the cam box 512 may be chosen to create the motion profile illustrated in FIG. 27 in a conventional manner.

Figure 19:
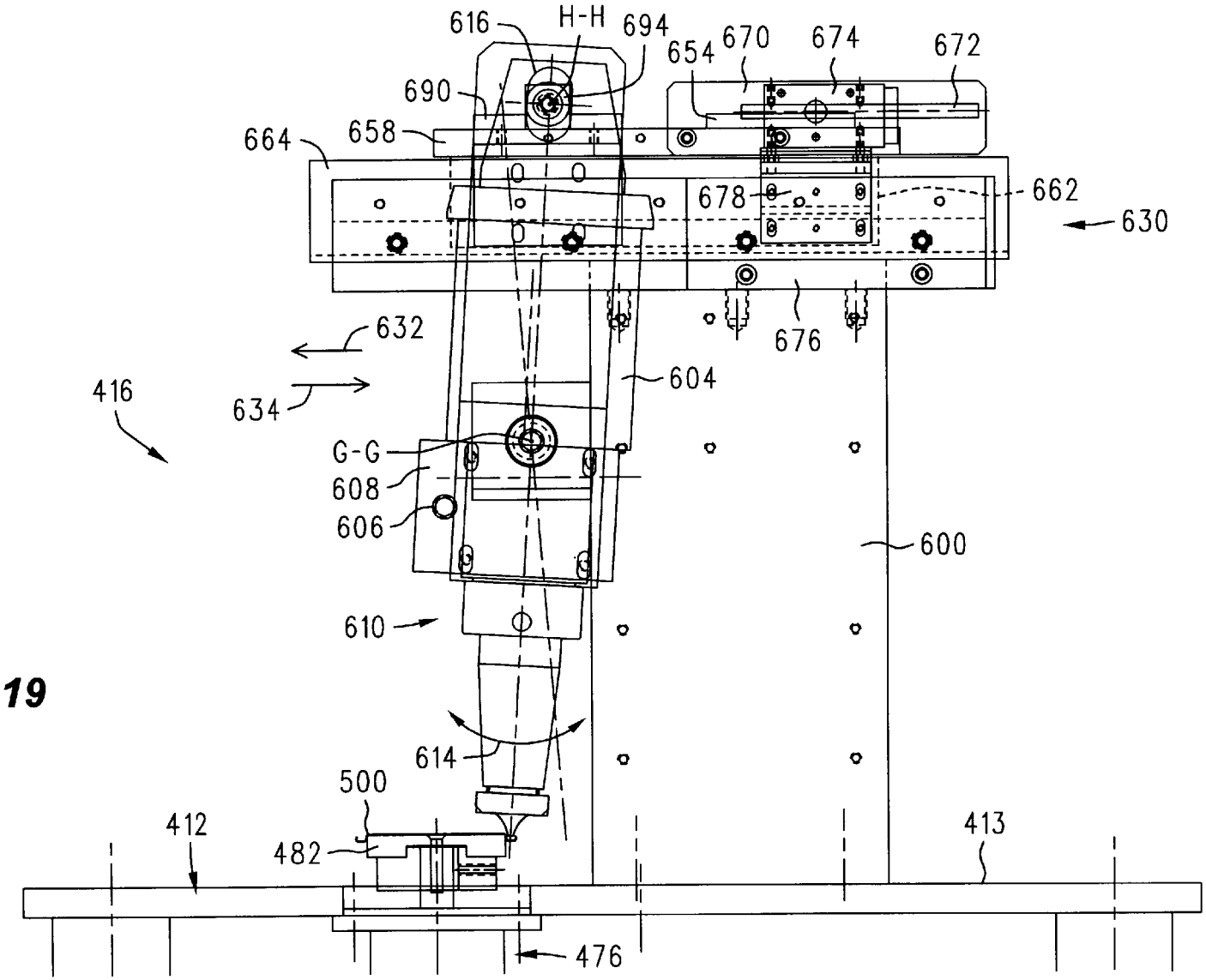
FIG. 19 is a front elevation view of a fluid dispensing system having a pivoting dispensing gun which is driven by a linear actuator.
Figure 20:
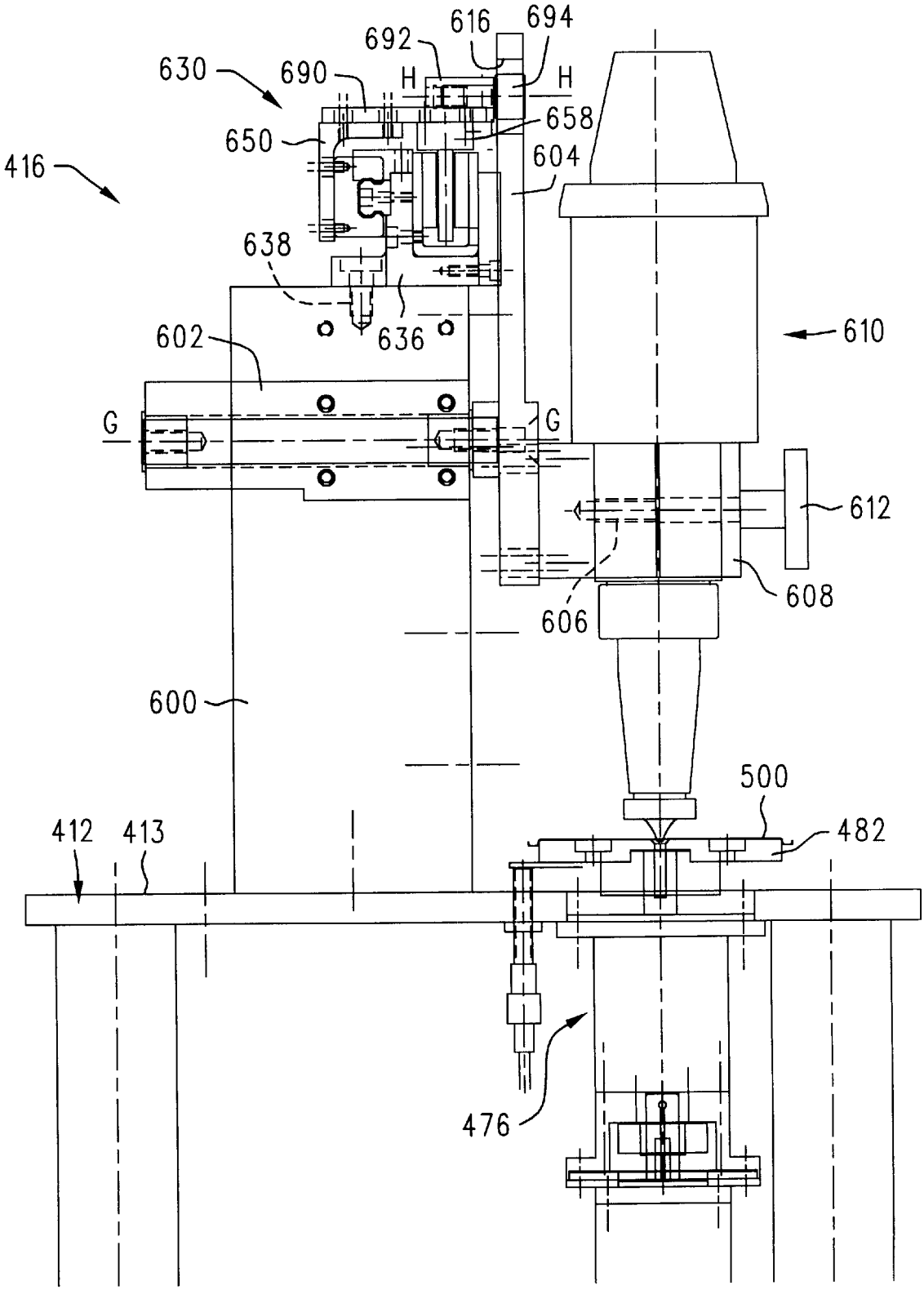
FIG. 20 is side elevation view of the fluid dispensing system of FIG. 19.

FIGS. 19–22 illustrate the upper assembly 416 of the sealant dispensing system 410 in further detail. Referring to FIGS. 19 and 20, upper assembly 416 may include a support member 600 extending upwardly from the upper surface 413 of the support structure 412 of the lower assembly 414. A bracket 602 may be attached to the support member 600, as best shown in FIG. 20. A cradle member 604 may be supported by the bracket 602 such that the cradle member is rotatable about the axis G—G. Cradle member 604 may include an elongated hole or slot 616, as shown. Cradle member 604 may further include a threaded hole 606, FIG. 19. A sealant dispensing gun 610 may be held within the cradle member 604 via a clamp member 608 which, in turn, may be secured to the cradle member 604 via a bolt 612, FIG. 20, engaged within the threaded hole 606. The dispensing gun 610 may, for example, be substantially identical to the dispensing gun 120 previously described with respect, e.g., to FIGS. 6 and 7.

As can be appreciated, the dispensing gun 610, mounted in a manner as described above, is able to pivot in the directions indicated by the arrow 614, FIG. 19, about the axis G—G. As can further be appreciated, the lower portion of the dispensing gun 610 will be located adjacent the chuck 482 of the lower assembly 414 and, thus, is able to apply sealant to closure members, such as the closure member 500 illustrated in FIGS. 19 and 20 in a manner as previously described.

Referring again to FIGS. 19 and 20, upper assembly 416 may further include a support and drive assembly 630. Support and drive assembly 630 may be mounted to the support member 600 in a manner as will be described in further detail herein. Generally, the support and drive assembly 630 includes a roller 694 which is forced to move in the linear directions indicated by the arrows 632, 634, FIG. 19. The roller 694, in turn, is captured within the slot 616 of the cradle member 604. As can be appreciated, movement of the roller 694 in the direction 632 will cause the lower portion of the dispensing gun 610 to pivot in a counter-clockwise direction about the axis G—G. Conversely, movement of the roller 632 in the direction 634 will cause the lower portion of the dispensing gun 610 to pivot in a clockwise direction about the axis G—G.

Figure 21:
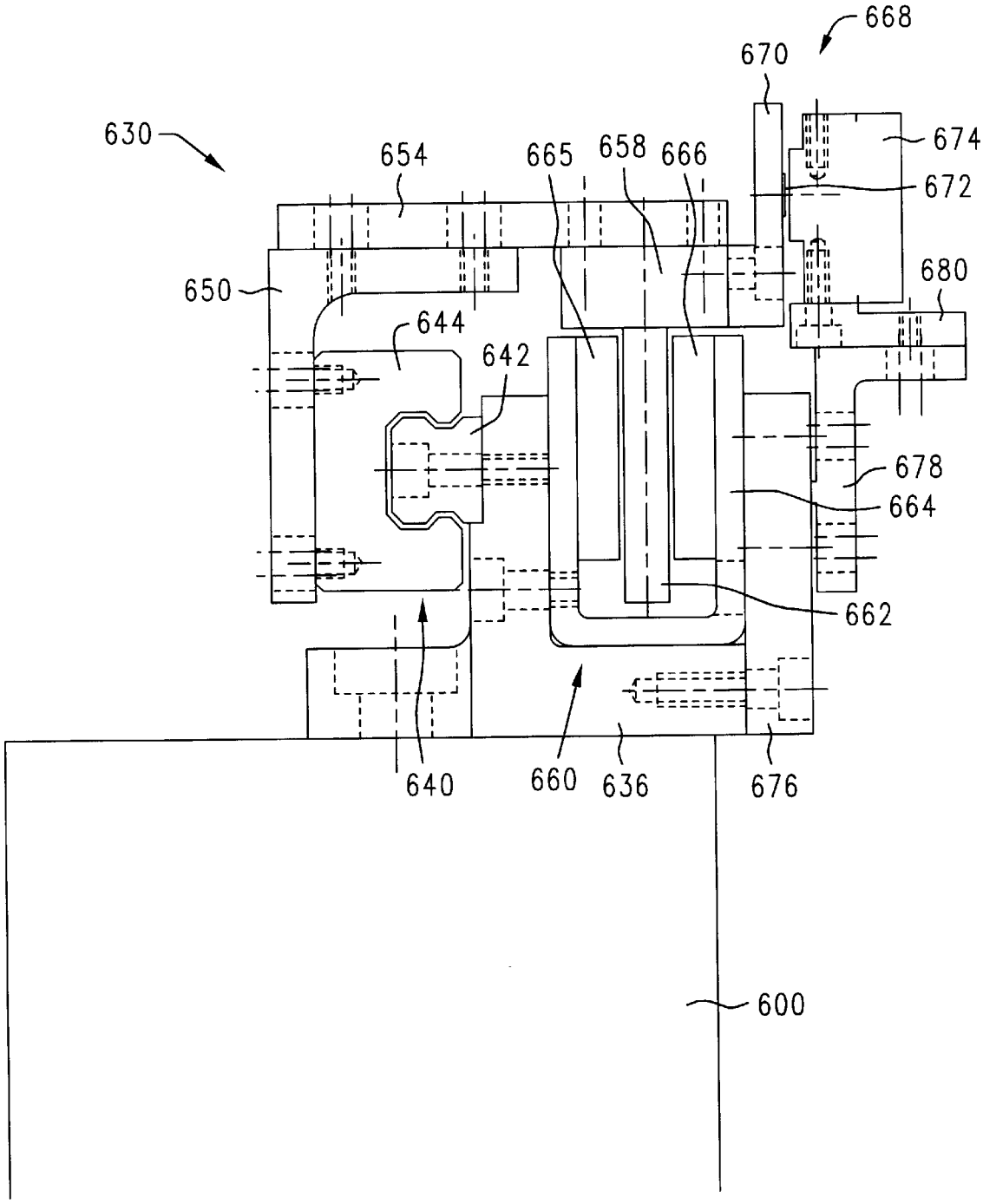
FIG. 21 is detailed side elevation view, in partial cross-section, of the fluid dispensing system of FIG. 19.
Figure 22:
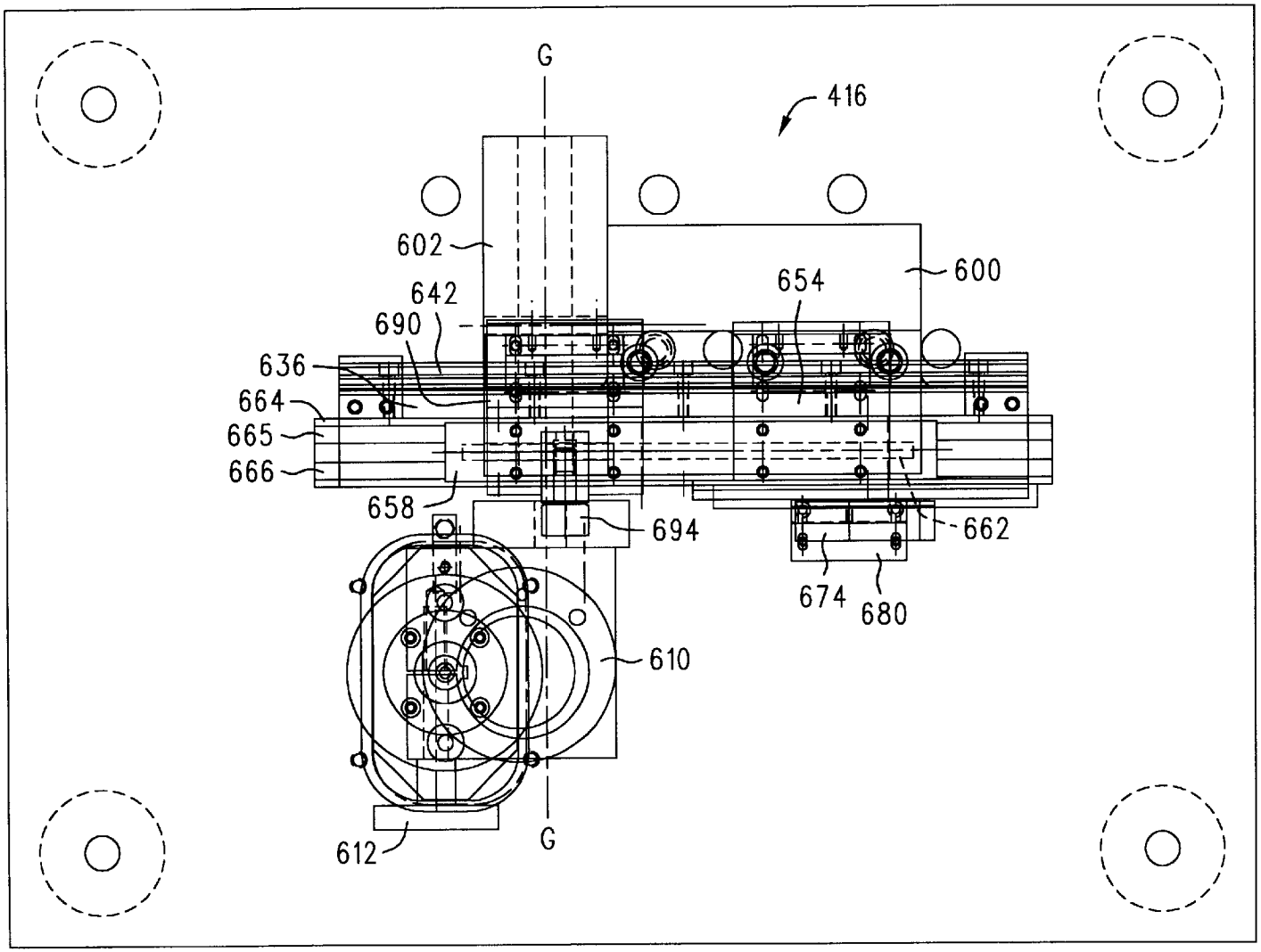
FIG. 22 is top plan view of the fluid dispensing system of FIG. 19.

With reference again to FIGS. 19–22, the configuration and operation of the support and drive assembly 630 will now be described in further detail. Support and drive assembly 630 may include an L-shaped support 636, FIGS. 20 and 21, which may be attached to the support member 600 via a plurality of bolts, such as the bolt 638, FIG. 20. Referring to FIG. 21, a guide rail 642 may be attached to the L-shaped support 636 as shown. A slide member 644 may be slidingly attached to the guide rail 642 such that the slide member 644, and components attached thereto, are moveable relative to the L-shaped support 636 in the directions indicated by the arrows 632, 634, FIG. 19. The guide rail 642 and slide member 644, together, may constitute a support mechanism 640. Support mechanism 640 may, for example, be a conventional slide support mechanism, such as the type commercially available from THK America Inc. of Cypress, Calif. and sold as Model SSR-15W.

Referring again to FIG. 21, a rear L-shaped bracket 650 may be attached to the support mechanism slide member 644 as shown. A first top bracket 654, in turn, may be attached to the rear L-shaped bracket 650. A block 658 may be attached to the first top bracket 654 and may be further attached to an armature portion 662 of a drive mechanism 660. A sensor bracket 670 may also be attached to the block 658 as shown. Sensor bracket 670 may include a linear encoder tape scale 672.

With further reference to FIG. 21, a front bracket 676 may be attached to the L-shaped support 636. An L-shaped bracket 678, in turn, may be attached to the front bracket 676. A support plate 680 may be attached to the L-shaped bracket 678 and may, in turn, support a sensor mechanism 674 as shown. Sensor mechanism 674 and tape scale 672, together, comprise a sensor assembly 668. In operation, the sensor mechanism 674 determines the position of the moveable sensor bracket 670 relative to the stationary sensor mechanism 674. Sensor assembly 668 may, for example, be a conventional sensor assembly, such as the type commercially available from Anorad Corporation of Hauppauge, N.Y. and sold as Model MERS50-D1.

A U-shaped member 664 may be attached to the L-shaped support 636 and located between the L-shaped support 636 and the front bracket 676 as shown. A pair of stator members 665, 666 may be supported by the U-shaped member 664. U-shaped member 664, stator members 665 and 666, armature portion 662 and block 658, together, may comprise a drive mechanism 660. Drive mechanism 660 may be a conventional electromagnetic linear actuator in which the armature portion 662 (along with the components attached thereto) may be driven in the directions 632, 634, FIG. 19, via interaction between the stationary stator members 665, 666 and the moveable armature portion 662. Drive mechanism 660 may, for example, be of the type commercially available from Anorad Corporation of Hauppauge, N.Y. and sold as Model LEM-S-3-S-NC-TE-HET. Alternatively, drive mechanism 660 may be configured as any other type of linear actuator, such as pneumatic or hydraulic actuator.

Referring to FIGS. 19 and 20, a second top bracket 690 may be attached to the L-shaped rear bracket 650 and to the block 658, as shown. A bracket 692, in turn, may be mounted to the second top bracket 690. Bracket 692 may support the roller 694, as previously described, for rotation about the axis H—H.

As can be appreciated, activation of the drive mechanism 660 will cause the armature portion 662 and attached rear L-shaped bracket 650 to be selectively moved in the directions 632 and 634, FIG. 19. This movement will also cause the roller 694, which is ultimately attached to the rear L-shaped bracket 650, to move in the directions 632, 634. This movement of the roller 694, in turn, will cause the dispensing gun 610 to pivot in the directions indicated by the arrow 614, FIG. 19, in a manner as previously described. The sensor assembly 668 serves to detect the relative position of the sensor bracket 670 and, thus, is able to determine the relative position of the roller 694 and, accordingly, direction and degree of pivoting of the dispensing gun 614. The sensor assembly 668, the drive mechanism 660, the dispensing gun 610 and the servo motor 476 may all be connected to a controller device, not shown, in a conventional manner in order to control and coordinate the movement of all of the components. A sensor, not shown, may also be connected to the controller device in a conventional manner in order to sense when the chuck 482 is in its raised position.

In operation, the dispensing gun 610 pivots as the chuck 482 rotates. Accordingly, the dispensing gun 610 may apply sealant to non-circular closure members in a manner similar to that described previously with respect to the pivoting dispensing gun 120, e.g., FIGS. 6 and 7. The dispensing gun 120, however, is pivoted by a rotary servo motor 230 and gearbox 232. The use of such a rotary servo motor and gearbox arrangement has been found to be disadvantageous in some circumstances. Specifically, it has been found that, in some circumstances, the tolerances and flexure inherent in the gears and other moving parts of the gearbox can make reliable high-speed operation problematic. The use of a linear actuator to pivot a dispensing gun, as described with respect to FIGS. 19–22, overcomes these potential problems associated with rotary servo motors and gears.

It is noted that the pivoting dispensing gun/linear actuator arrangement of FIGS. 19–22 has been described in conjunction with an indexing type sealant dispensing system (i.e., the system 410, FIG. 17) for illustration purposes only. In use, the pivoting dispensing gun/linear actuator arrangement could readily, instead, be used in conjunction with a rotary sealant dispensing system, such as the rotary systems described herein with respect to FIGS. 1–9 or FIGS. 12–14.

Figure 23:
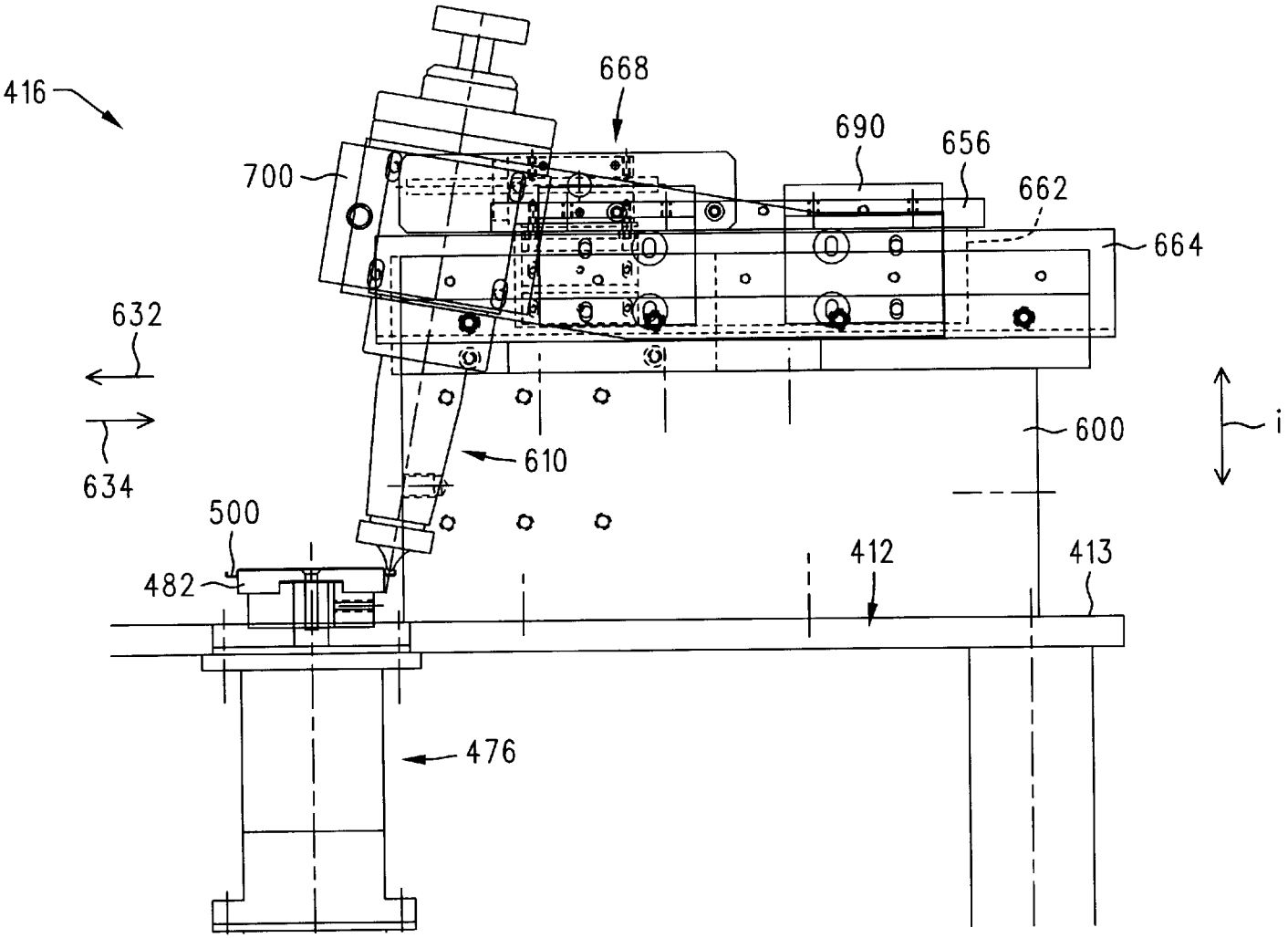
FIG. 23 is a front elevation view of a fluid dispensing system having a dispensing gun which moves in a linear fashion and which is driven by a linear actuator.
Figure 24:
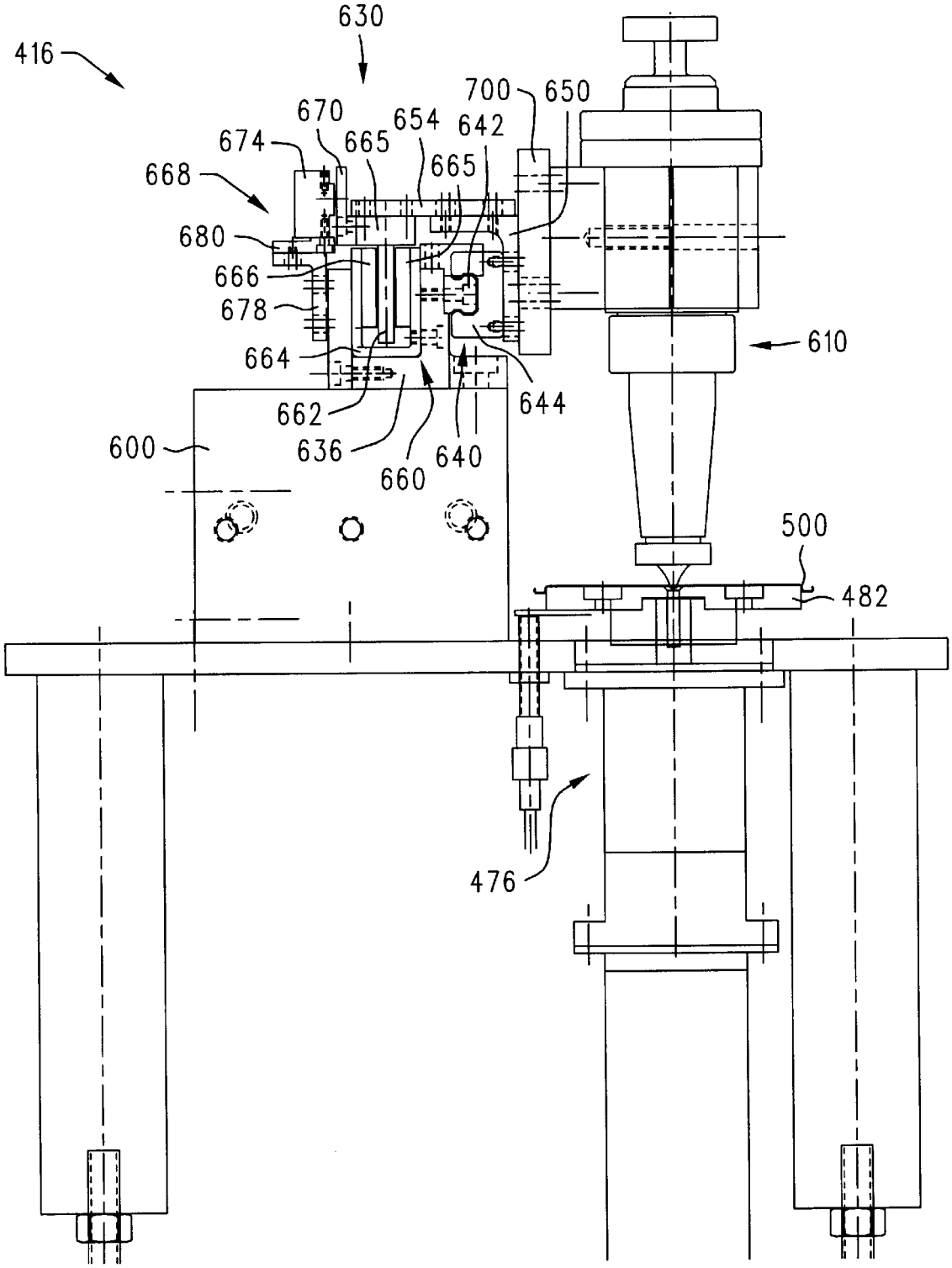
FIG. 24 is side elevation view of the fluid dispensing system of FIG. 23.
Figure 25:
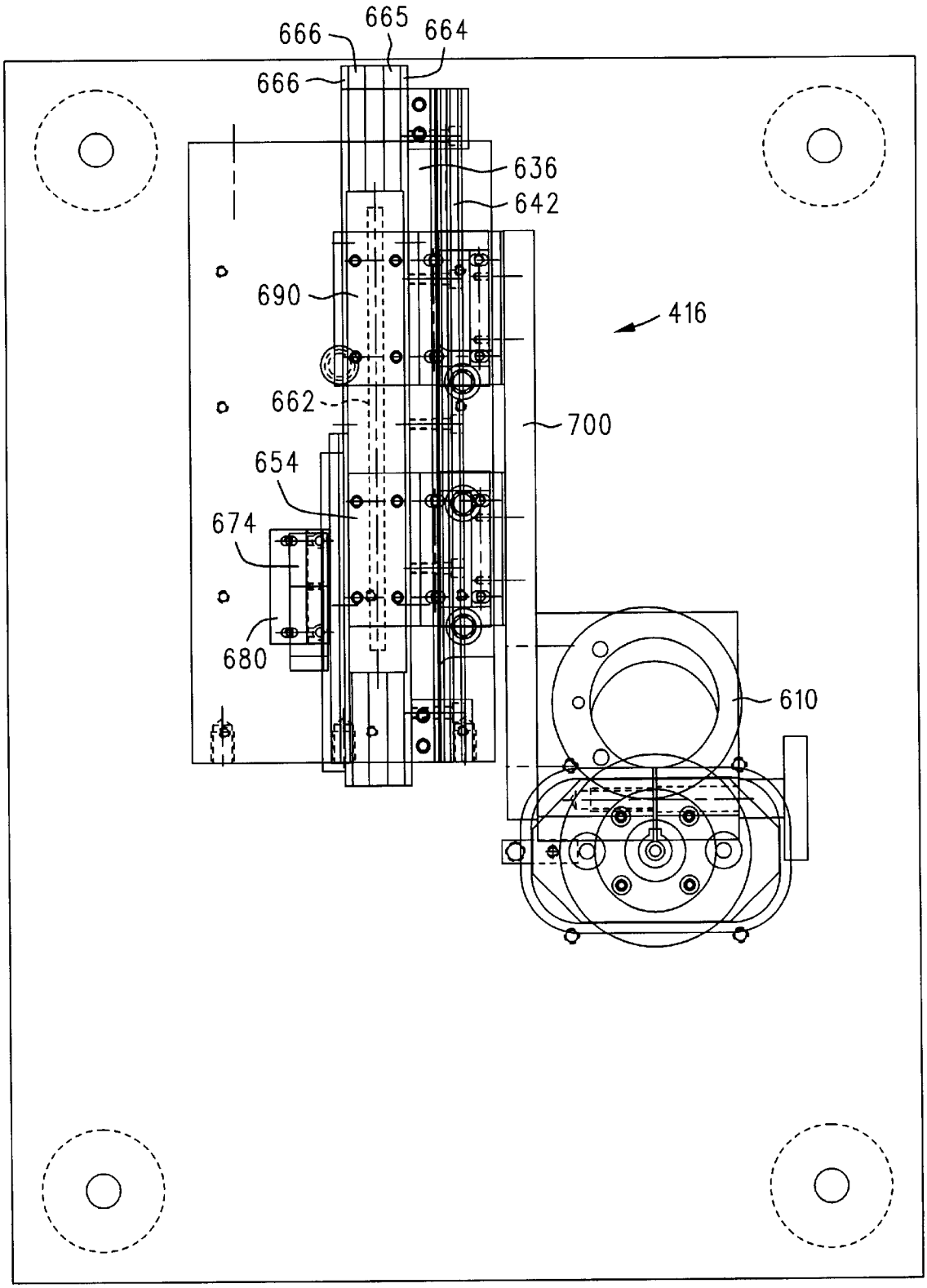
FIG. 25 is top plan view of the fluid dispensing system of FIG. 23.

FIGS. 23–25 illustrate an alternative embodiment of the upper assembly 416. The embodiment of FIGS. 23–25 may be substantially similar to the pivoting dispensing gun/linear actuator described above with reference to FIGS. 19–22. Accordingly, like elements in FIGS. 23–25 are afforded the same reference numerals as used in FIGS. 19–22. In the embodiment of FIGS. 23–25, however, the dispensing gun 610 does not pivot. Instead, the gun 610 is rigidly attached to the support and drive assembly 630. Accordingly, the dispensing gun 610 moves only in a linear fashion, i.e., in the directions indicated by the arrows 632, 634, FIG. 23.

As can be appreciated, with reference to FIG. 24, the support and drive assembly 630 may be substantially identical to that previously described with respect to FIGS. 19–22 except that the entire assembly 630 is mounted in the opposite orientation. In other words, the support mechanism 640, in the embodiment of FIGS. 23–25, is located closer to the dispensing gun 610, while the drive mechanism 660 is located further away. This orientation of the support and drive assembly 630 allows a bracket 700 to be attached directly to the L-shaped bracket 650. The dispensing gun 610, in turn, may be attached to the bracket 700. Specifically, the dispensing gun 610 may be attached to the bracket 700 in a similar manner to that described with respect to the attachment of the dispensing gun to the cradle 604 in FIGS. 19–22. It is noted that, to facilitate this alternate mounting arrangement of the dispensing gun 610, the height "i", FIG. 23, of the support member 600 may be reduced relative to the height of the support member in the embodiment of FIGS. 19–22.

As can be appreciated, in the embodiment of FIGS. 23–25, the upper assembly 416 may function in a similar manner to that described with respect to FIGS. 19–22. In the embodiment of FIGS. 23–25, however, the dispensing gun 610 will move only in a linear fashion, i.e., in the directions 632, 634, FIG. 23.

In a similar manner to the embodiment of FIGS. 15 and 16, as previously described, the linear motion dispensing gun of FIGS. 23–25 is advantageous in that the dispensing gun opening does not move in an arcuate fashion and, thus, the dispensing angle of the gun remains constant relative to the closure member. The embodiment of FIGS. 23–25 is further advantageous relative to the embodiment of FIGS. 15 and 16, however, in that the embodiment of FIGS. 23–25 reduces the undesirable play and flexure characteristics of a gear and belt driven system, such as that described with respect to FIGS. 15 and 16.

It is noted that the linear motion dispensing gun/linear actuator arrangement of FIGS. 23–25 has been described in conjunction with an indexing type sealant dispensing system (i.e., the system 410, FIG. 18) for illustration purposes only. In use, the linear motion dispensing gun/linear actuator arrangement could readily, instead, be used in conjunction with a rotary sealant dispensing system, such as the rotary systems described herein with respect to FIGS. 1–9 or FIGS. 12–14.

It is noted that the indexing system 410 of FIGS. 17 and 18 has been described in conjunction with particular configurations for the upper assembly 416 (i.e., the configuration of FIGS. 19–22 and the configuration of FIGS. 23–25) for exemplary purposes only. The indexing system could, alternatively, be configured having any type of upper assembly 416, such as a pivoting dispensing gun/rotary actuator (e.g., FIGS. 1, 2, 4, 6, 7 and 12) or a linear motion dispensing gun/rotary actuator (e.g, FIGS. 15 and 16).

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A fluid dispensing system comprising:

a support structure;

a fluid dispensing mechanism comprising:

a first opening in said fluid dispensing mechanism, said first opening being attached to a supply of fluid;

a second opening in said fluid dispensing mechanism;

a fluid flow path extending through said fluid dispensing mechanism and connecting said first opening and said second opening;

a chuck member rotatably mounted to said support structure about a rotation axis;

a container closure member at least partially supported by said chuck member;

wherein said fluid dispensing mechanism is pivotally attached to said support structure about a pivot axis;

wherein, said rotation axis is fixed relative to said support structure; and wherein, said system is adapted to apply fluid to said container closure member in a preprogrammed non-circular pattern via a controlled rotation of said chuck member about said rotation axis and a controlled pivoting of said fluid dispensing mechanism about said pivot axis.

2. The apparatus of claim 1 and further comprising:

a servo motor operatively attached to said fluid dispensing mechanism.

3. The apparatus of claim 1 wherein said fluid is a sealant.

4. The apparatus of claim 1 wherein said pivot axis is substantially perpendicular to said rotation axis.

5. The apparatus of claim 1 wherein said container closure member is non-circular.

6. The apparatus of claim 1 and further comprising:

a servo motor operatively attached to said chuck member.

* * * * *